US005392706A

United States Patent [19]

Drew, II et al.

[11] Patent Number: 5,392,706

[45] Date of Patent: Feb. 28, 1995

[54] PAD TRANSFER PRINTING METHOD

[75] Inventors: L. Edward Drew, II, Keene; Mark C. Viklund, East Swanzey; Richard H. Frye, Westmoreland; Charles F. Gibson, Keene; Barry S. Shonbeck, Westmoreland, all of N.H.

[73] Assignee: Markem Corporation, Keene, N.H.

[21] Appl. No.: 921,852

[22] Filed: Jul. 30, 1992

[51] Int. Cl.[6] ..... B41M 1/10

[52] U.S. Cl. ..... 101/170; 101/163

[58] Field of Search ..... 101/41, 42, 44, 150, 101/163, 170, 164, 165, 166

[56] References Cited

U.S. PATENT DOCUMENTS

| | | | |
|---|---|---|---|
| Re. 31,229 | 5/1983 | King | 318/696 |
| 1,827,685 | 1/1931 | Chester et al. | 101/163 |
| 3,216,349 | 11/1965 | Kraft | 101/123 |
| 3,831,517 | 8/1974 | Wagner | 101/208 |
| 3,868,902 | 3/1975 | Bradshaw et al. | 101/44 |
| 4,282,471 | 8/1981 | Budniak et al. | 318/685 |
| 4,282,807 | 8/1982 | Turnock | 101/41 |
| 4,314,504 | 2/1982 | Combeau | 101/41 |
| 4,414,892 | 11/1983 | Strafello | 101/44 |
| 4,459,675 | 7/1984 | Bateson et al. | 364/519 |
| 4,496,891 | 1/1985 | Kobayashi | 318/696 |
| 4,557,195 | 12/1985 | Philipp | 101/163 |
| 4,672,283 | 6/1987 | Kobayashi | 318/696 |
| 4,738,198 | 4/1988 | Sillner | 101/41 |
| 4,742,287 | 5/1988 | Yokoi et al. | 318/696 |
| 4,854,230 | 8/1989 | Niki et al. | 101/123 |
| 4,928,587 | 5/1990 | Glover | 101/42 |
| 5,003,872 | 4/1991 | Dalferth | 101/163 |
| 5,088,401 | 2/1992 | Fujino et al. | 101/41 |
| 5,158,018 | 10/1992 | Masaki et al. | 101/158 |

FOREIGN PATENT DOCUMENTS

| | | | |
|---|---|---|---|
| 0190846 | 8/1986 | European Pat. Off. . | |
| 1923374 | 2/1970 | Germany . | |
| 2205430 | 6/1981 | Germany . | |
| 239986 | 10/1986 | Germany . | |
| 3539133 | 5/1987 | Germany . | |
| 8804891 | 9/1988 | Germany . | |
| 3737013 | 5/1989 | Germany . | |
| 1188260 | 1/1988 | Italy . | |
| 0028861 | 3/1981 | Japan | 101/41 |
| 0028281 | 2/1987 | Japan | 101/163 |
| 0128941 | 6/1988 | Japan | 101/163 |
| 2171645 | 9/1986 | United Kingdom | 101/163 |

OTHER PUBLICATIONS

"Stampanti a Tampone Computerizzate" (Tosh Italia), with translation.

"Cassco Logica Silicone Pad Printers" (Cassco Machines).

*Primary Examiner*—Edgar S. Burr

*Assistant Examiner*—Christopher A. Bennett

*Attorney, Agent, or Firm*—Roylance, Abrams, Berdo & Goodman

[57] ABSTRACT

A method for carrying out pad transfer printing is disclosed in which process parameters for a desired print cycle are input to a controller. The method includes the steps of independently driving a gravure printing plate between an inking position and an ink transfer position, and independently driving an ink transfer pad between an ink receiving position and an ink transfer position, both in accordance with the input process parameters. The process parameters may include the velocities or lengths of movement of the gravure printing plate and ink transfer pad, and the dwell periods between movements of these components. The process parameters may be adjusted automatically in accordance with differences between the estimated and actual times required to move the printing plate and transfer pad along their paths of movement.

20 Claims, 31 Drawing Sheets

PAD TRANSFER PRINTING METHOD

BACKGROUND OF THE INVENTION

The present invention relates generally to a pad printing apparatus that employs an engraved printing plate and a deformable ink transfer pad made of silicone rubber or the like, and is particularly concerned with a drive and control system whereby the printing plate and transfer pad are independently driven and controlled. The present invention is also particularly concerned with a closed-reservoir inking assembly for supplying ink to the engraved area of the printing plate.

Typically, with pad transfer printing, an inked image is lifted from the engraved area of an engraved printing plate and is transferred to a surface to be printed by a resilient ink transfer pad, normally made of silicone rubber. The surface characteristics of the silicone rubber are such that the ink easily releases from the pad and adheres to the print receiving surface. The transfer pad typically can elastically deform during printing so that virtually any type of raised or irregular shaped surface can be printed, in addition to flat surfaces.

Various types of automatic printing machines have been developed that employ the pad transfer process. Typically, these machines have an engraved printing plate which is moved between an inking position, where an inking assembly supplies ink to the engraving, and a contact position, where a silicone transfer pad is brought into contact with the inked engraving. The transfer pad typically moves between the printing plate and the surface to be printed. Usually, a common drive system is provided for synchronously moving the printing plate and the transfer pad. The drive system typically includes a linkage for mechanically linking the printing plate and transfer pad so that their movements are slaved or synchronized. Although a common drive system may aid in coordinating the movement of the transfer pad and printing plate, such a slaved system does not allow the pad-printing process to be readily optimized nor allow for many variations in the print cycle. Any adjustments made to the operation of the drive system would necessarily affect the movement of both the printing pad and printing plate. Consequently, conventional drive systems typically will have limited operating ranges. Furthermore, those drive systems typically do not provide a very high degree of precision.

Both open and closed reservoir ink assemblies are known which may be employed in a pad transfer printing apparatus. With an open-reservoir ink assembly, typically, the ink is held in an open trough or reservoir. The engraved area of the printing plate is filled by taking the ink from the trough or reservoir by means of a brush, spreader blade, wire applicator or the like, and applying the ink to the engraved area of the printing plate. A doctor blade or other type of wiping or scraping device is then used to remove excess ink from the plate so that the ink remains only in the grooves or depressions which define the legend to be printed.

With a closed-reservoir ink assembly, the ink reservoir may be inverted and the printing plate positioned beneath the assembly so that the plate holds the ink within the reservoir. As the engraved image of the printing plate moves beneath the reservoir, the ink fills the engraving. Typically, the closed-reservoir ink assembly is provided with a doctoring edge that scrapes excess ink from the plate as the plate moves underneath the ink assembly. In some closed-reservoir ink assemblies the doctoring edge is provided on the inverted reservoir. Furthermore, the assemblies usually include biasing means for applying pressure to the reservoir so that the reservoir is held tightly against the printing plate and the doctoring edge can effectively scrape excess ink from the printing plate. The conventional closed-reservoir ink assemblies, however, typically have a relatively complex structure and therefore can be expensive to manufacture and replace. With one known ink assembly, the ink reservoir, that holds the ink and has the doctoring edge, includes the components for biasing the reservoir against the printing plate. Furthermore, the reservoir includes components for feeding ink into and out of the reservoir and a coupling device for mounting the reservoir to a printing machine. With another known ink assembly, the ink reservoir is mounted into the machine. Should the doctoring edge become worn and either of these reservoirs need to be replaced, the costs associated with manufacturing a new reservoir that includes all the required accessories can be relatively high. Furthermore, due to the number of components and the manner in which the reservoir is typically mounted to the printing machine, the changing of ink type or color can be a time-consuming process involving a high risk of ink spillage as the reservoir is removed, cleaned, filled with ink, and replaced in the machine.

SUMMARY OF THE INVENTION

In accordance with the present invention, a pad printing machine is provided that comprises a pad holder for removably holding an ink transfer pad and a plate holder for removably holding an engraved printing plate. A pad driving assembly is coupled to the pad holder for driving the pad holder along a first axis. A separate plate driving assembly is coupled to the plate holder for driving the plate holder along a second axis. The pad printing machine is provided with an ink assembly for applying ink to the engraving of the printing plate. Included with the pad printing machine is a control system that independently controls the pad driving assembly and the plate driving assembly. In a preferred embodiment of the invention, the pad driving assembly comprises a lead screw coupled to the pad holder and a stepping motor drivingly coupled to the lead screw, and the plate driving assembly comprises a lead screw coupled to the plate holder and a stepping motor drivingly coupled to the lead screw.

In a preferred embodiment of the invention, the control system includes a user interface whereby a user can enter process parameters related to the printing operation. A central controller in communication with the user interface, the pad driving assembly, and the plate driving assembly is operable to activate the driving assembly in accordance with the user input process parameters.

The present invention also provides a method of pad transfer printing comprising the steps of inputting process parameter regarding a desired print cycle to a controller; independently driving a gravure printing plate between an inking position and an ink transfer position in accordance with the process parameters; and independently driving an ink transfer pad between an ink receiving position and an ink transfer position in accordance with the process parameters. In a preferred embodiment of the invention, the process parameters include the velocity and length of the movements of the gravure printing plate and the ink transfer pad. The present invention also includes a method of controlling a pad transfer printing cycle that includes at least one step of moving a gravure printing plate and at least one step of moving an ink transfer pad. The method includes the steps of inputting process parameters to a controller regarding a desired printing cycle; calculating the estimated time required to move each of the gravure printing plate and the ink transfer pad based on the process parameters; moving the gravure printing plate in accordance with the process parameters and measuring the actual time of movement; comparing the estimated time required to move the gravure printing plate with the actual time of the movement; and adjusting the printing cycle time if the difference between the estimated time and actual time is above a predetermined threshold amount.

The present invention also provides an ink assembly for applying ink to a printing plate. The ink assembly comprises an ink cup that is open on one side and an ink cup holder that has a recess for receiving the ink cup. The ink cup holder is provided with at least one magnet. The ink cup is releasably retained in the recess of the ink cup holder by a magnetic force produced by the magnet. In a preferred embodiment of the invention, the ink cup has a doctoring edge adjacent the opening. In another preferred embodiment, a doctoring ring is provided which is removably disposed in the ink cup such that the edge of the ring protrudes from the cup holder. In a preferred embodiment of the invention, the ink assembly also includes a clamping assembly for releasably clamping the ink cup holder and ink cup in a printing machine. The clamping assembly comprises a spring for applying a downward pressure on the ink cup holder.

BRIEF DESCRIPTION OF THE DRAWINGS

The various objects, advantages and novel features of the invention will be more readily understood from the following detailed description when read in conjunction with the appended drawings, in which.

Throughout the drawings, like reference numerals will be understood to refer to like parts.

DETAILED DESCRIPTION OF THE PREFERRED EMBODIMENT

Figure 1:
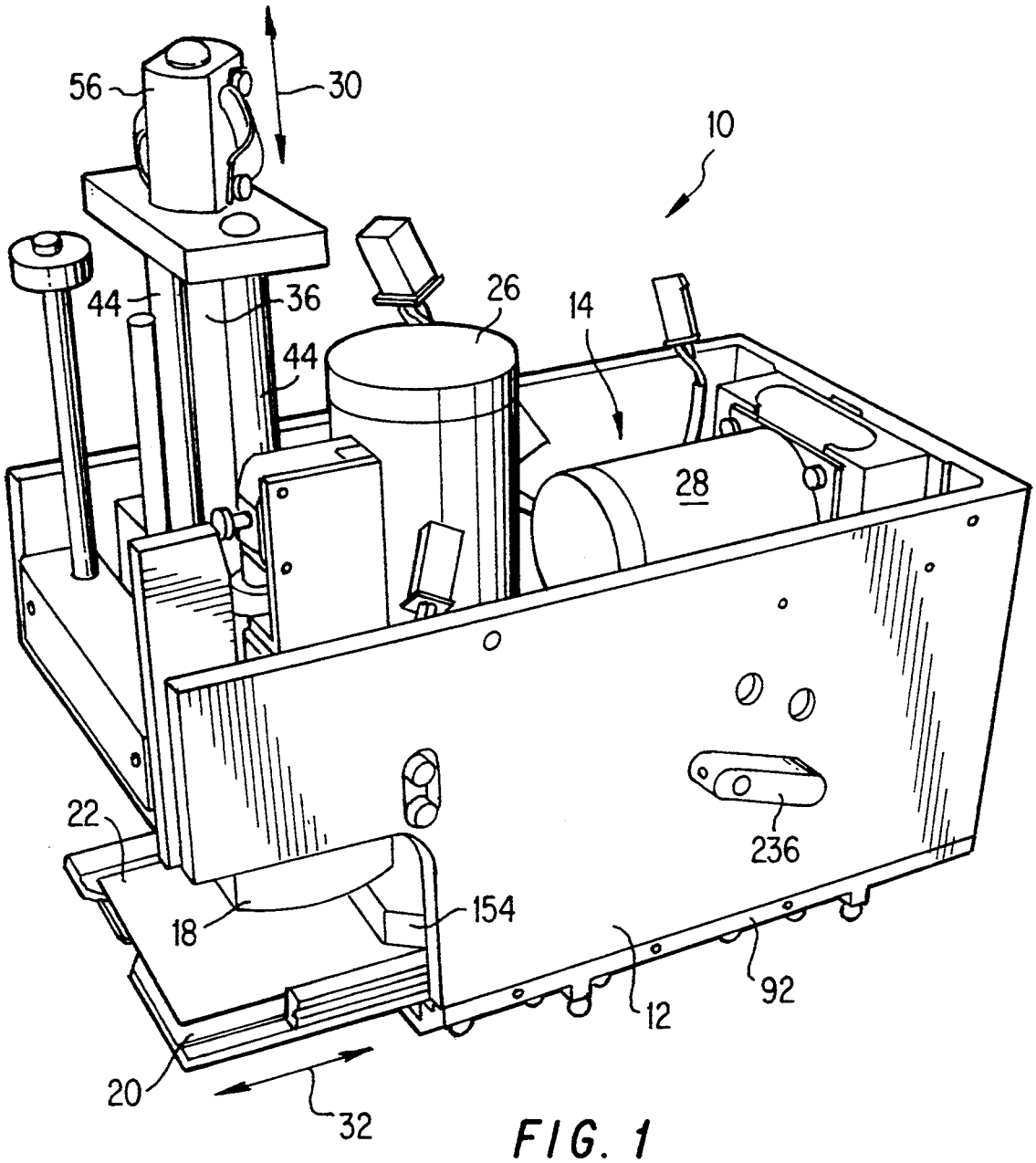
FIG. 1 is a perspective view of a pad printing machine in accordance with the present invention.
Figure 2:
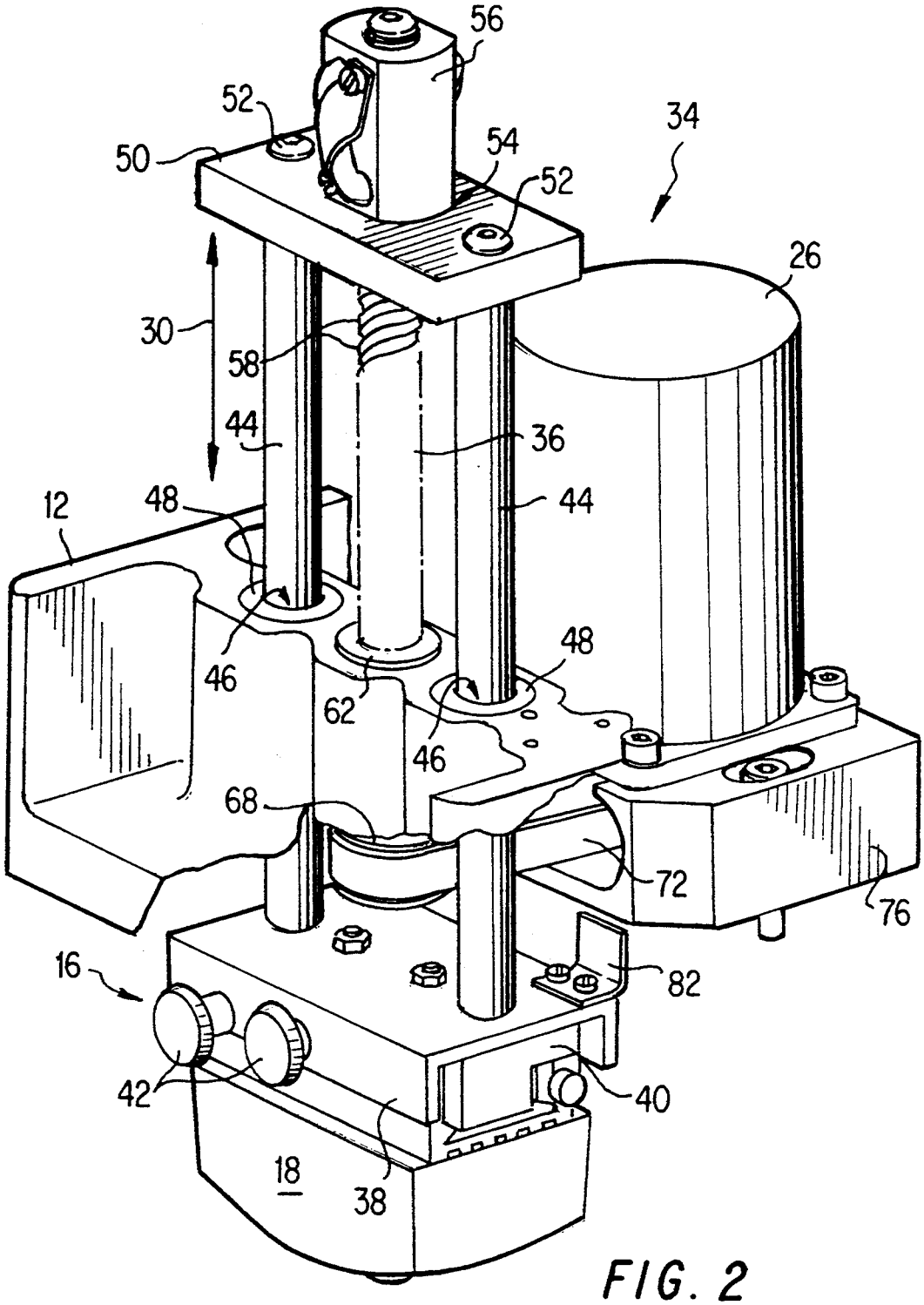
FIG. 2 is a perspective view of the pad holder drive assembly of the pad printing machine of FIG. 1.
Figure 3:
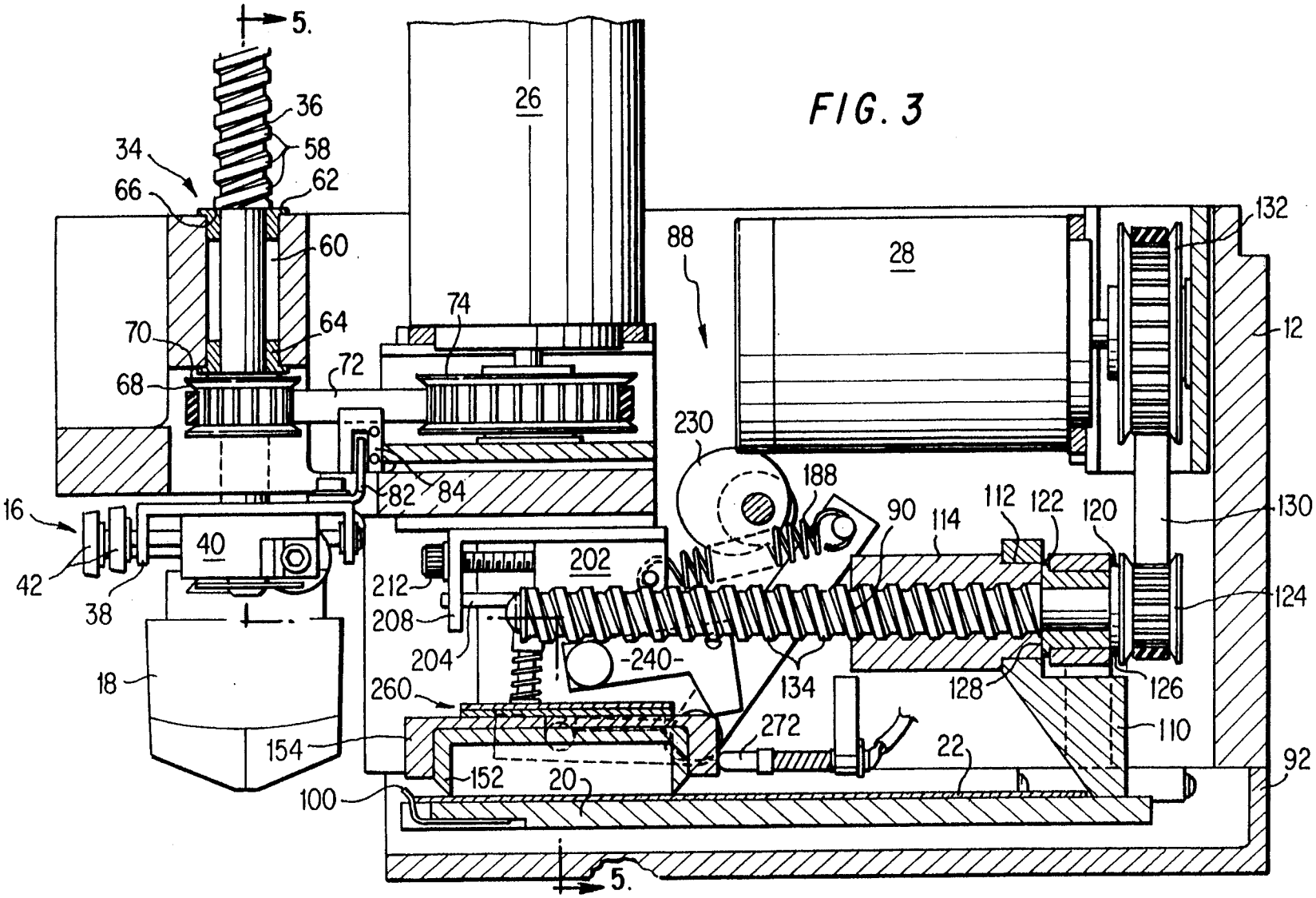
FIG. 3 is a side cross-sectional view of the pad printing machine of FIG. 1 with the plate holder in a retracted position.
Figure 4:
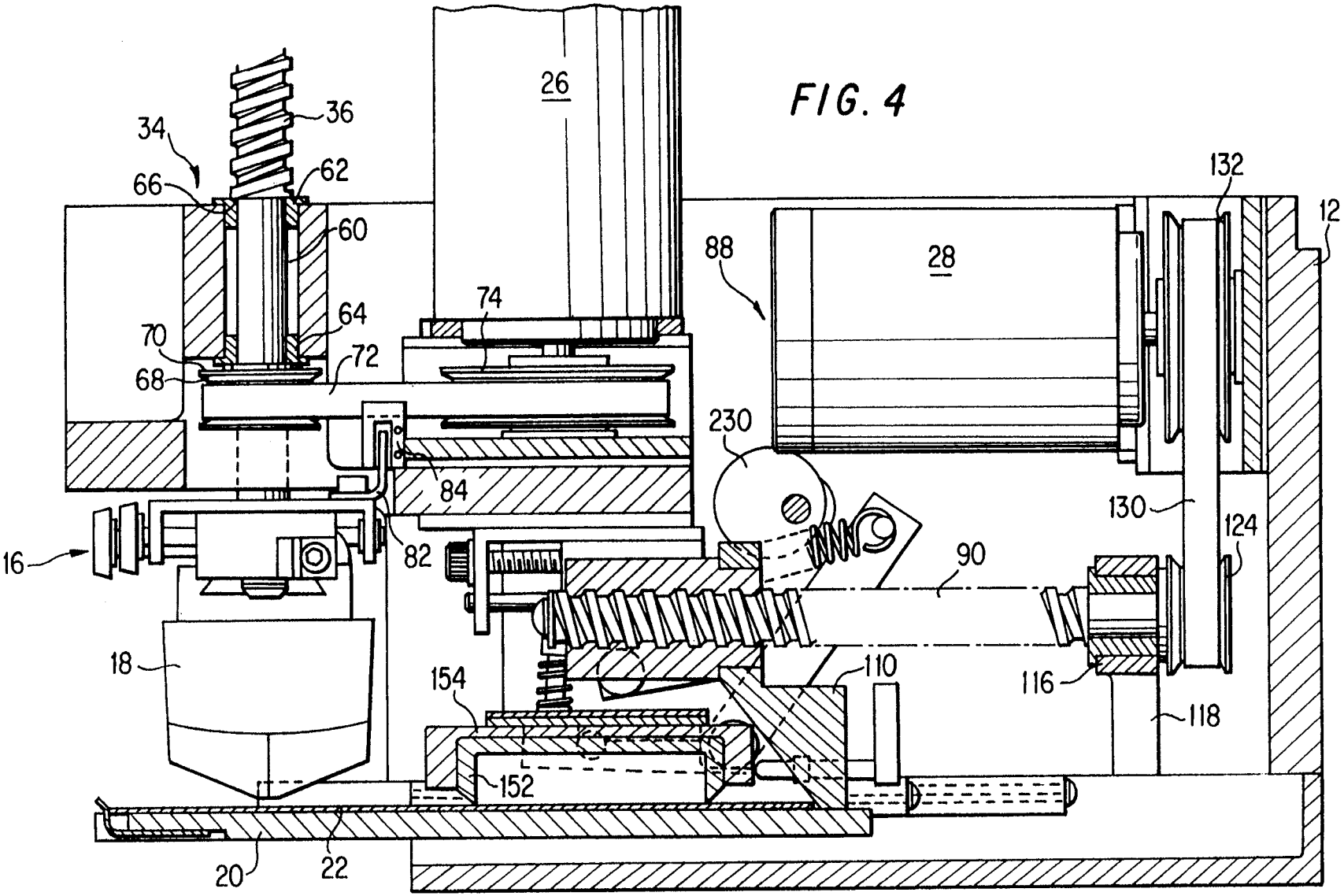
FIG. 4 is a side cross-sectional view of the pad printing machine of FIG. 1 with the plate holder in an extended position.

FIG. 1 illustrates a preferred embodiment of a pad printing machine 10 constructed in accordance with the present invention. The printing machine 10 includes a main frame 12 that supports a computer-controlled drive system 14 for moving a printing pad holder 16 (not shown in FIG. 1) that holds a silicone transfer printing pad 18 and a plate holder 20 that holds an engraved printing plate 22. Mounted within the main frame 12 is an inking assembly that includes a removable reservoir for supplying ink to the printing plate 22. The main frame 12 is preferably made of metal casting and is preferably provided with a removable cover for protecting the components mounted within the frame. For clarity, the cover is not shown in the figures.

As explained in more detail below, the drive system 14 includes two separate drive assemblies that independently drive the printing pad holder 16 and the plate holder 20. The drive assemblies include respective stepping motors 26, 28 that are independently controlled by a control system (discussed in more detail further below). The printing pad 18 is driven along a substantially vertical axis as indicated by the direction arrows 30, whereas the plate holder 20 is driven along a substantially horizontal axis as indicated by arrows 32. The plate holder 20 moves between a retracted position wherein the holder 20 is substantially enclosed within the main frame 12 and an extended position wherein the holder 20 protrudes from the frame 12. When the plate holder 20 is in the retracted position, the engraved image of the printing plate 22 carried on the plate holder 20 is brought beneath the inking assembly so that the engraving may be filled with ink. When the plate holder 20 is in the extended position, the inked engraving of the printing plate 22 is brought into alignment with the path of the printing pad 18.

The printing pad 18 moves between a retracted, raised position and an extended, lowered position. In its extended position, the printing pad 18 may contact either the inked printing plate 22 or an article to be printed depending on which component is presented below the printing pad 18. In normal operation (as discussed in more detail below), if the inked printing plate 22 is presented below the printing pad 18, the printing pad 18 is lowered into pressing contact with the inked engraving. The printing pad is then withdrawn from the contact thereby lifting the inked image from the plate 22. Subsequently, the printing plate 22 is withdrawn to its retracted position allowing an article to be presented at a position below the printing pad 18. The printing pad 18 is then lowered into contact with the article in order to transfer the inked image to the article.

FIGS. 2–6 illustrate the two drive assemblies 34 and 88 for driving the pad holder 16 and the plate holder 20, respectively. With reference to FIGS. 2–5, the pad holder drive assembly 34 includes the stepping motor 26 and a vertically-extending lead screw 36 drivingly coupled to the stepping motor 26 and the pad holder 16. The pad holder 16 preferably includes a pad support block 38 and a pad adjustment block 40 to which an ink transfer pad 18 may be mounted. Transfer pads of different sizes, shapes, and durometer may be employed, depending on the size of the image to be printed and the shape of the article to receive the image. The pad holder 16 includes adjustment screws 42 that may be manipulated to move the adjustment block 40 so that the transfer pad 18 is appropriately positioned for a desired printing operation.

The pad support block 38 is secured to the bottoms of two generally vertically extending support shafts 44. The support shafts 44 are slidingly received through holes 46 provided in the main frame 12. Bushings 48 line the inner surfaces of holes 46 so that the shafts 44 may move smoothly up and down through the holes 46. The upper ends of the support shafts 44 are secured to a ball nut mounting bracket 50 by threaded fasteners 52. The mounting bracket 50 is provided with a central opening 54 for receiving a ball nut 56 that is threadably mounted onto the lead screw 36. The lead screw 36 is provided with helical gear teeth 58 that engage co-acting threads within the ball nut 56 to effect movement of the ball nut 56 along the lead screw 36 when the lead screw is rotated.

The lead screw 36 extends through a bore 60 provided in the main frame 12. Positioned at either end of the bore 60 are upper and lower flange bearings 62, 64 which support the lead screw 36 and allow free rotation of the lead screw 36 within the bore 60. The lead screw 36 has a slightly reduced diameter in the region accommodated in the bore 60 of the main frame 12. This reduced diameter defines a shoulder 66 which provides a surface against which the upper bearing 62 contacts to prevent any downward motion of the lead screw 36. The lower end of the lead screw is fixed to a notched pulley 68 which when rotated causes the lead screw 36 to rotate. The pulley 68 includes a surface 70 that contacts the lower flange bearing 64 to prevent upward motion of the lead screw 36.

The notched pulley 68 is coupled to a closed-loop timing belt 72 that also extends around a drive pulley 74 coupled to the stepping motor 26. The stepping motor 26 is mounted to a motor block 76 secured to the main frame 12 by threaded fasteners. When the stepping motor 26 is activated, it rotates the drive pulley 74 causing the timing belt 72 to move and, hence, the notched pulley 68 and lead screw 36 to rotate. When the lead screw 36 rotates, the helical teeth 58 interact with the inner threads of the ball nut 56 causing the ball nut 56 to move along the lead screw 36. As the ball nut 56 moves along the lead screw 36, it pulls the bracket 50, support shafts 44, and pad holder 16 in a vertical direction.

The pad holder 16 may be provided with a conventional contact switch for determining when the pad holder 16 is in its fully retracted or "home" position. Such a switch may be in the form of a home vane 82 extending from the pad support block and a home switch block 84 mounted to the main frame 12. When the pad support block 38 is in its fully retracted position, the home vane 82 engages the home switch block 84 closing a circuit coupled to the control system.

Figure 5:
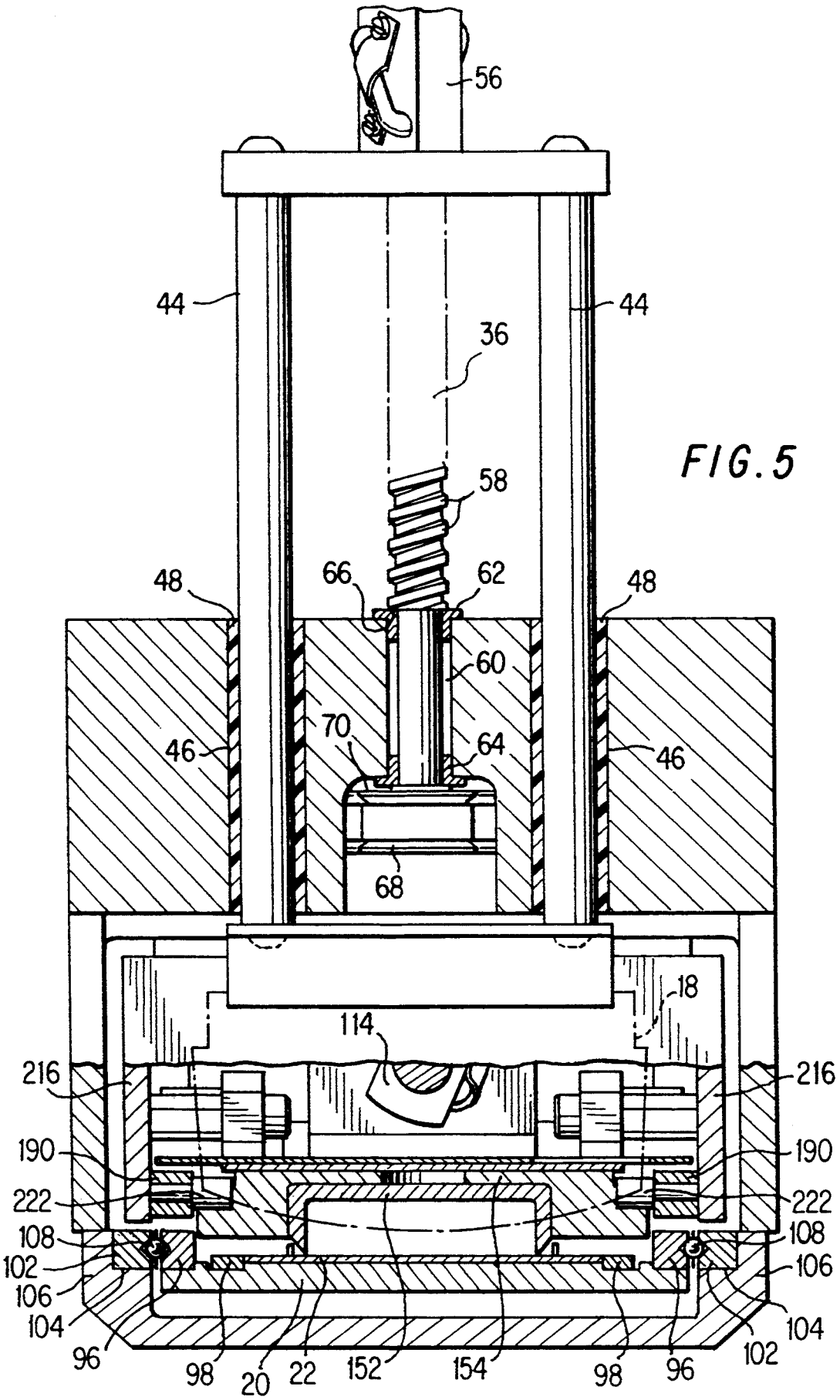
FIG. 5 is a front cross-sectional view of the pad printing machine taken along line 5—5 of FIG. 3.

With reference to FIGS. 6 and 3–5, the printing plate holder drive assembly 88 includes the stepping motor 28 and a lead screw 90 coupled to the stepping motor 28 and the plate holder 20. The printing plate holder 20 is slidingly mounted to a removable bottom section 92 of the main frame 12. The plate holder 20 comprises a generally flat member 94 with a pair of linear bearings 96 and plate guides 98 attached to the upper surface of the member 94. The plate guides 98 and a side spring 100 mounted to the front of the plate holder 20 serve to hold a printing plate 22 properly aligned on the upper surface of the plate holder 20. A pair of complementary linear bearings 102 are mounted to respective ledges 104 formed in the sides 106 of the bottom section 92 of the main frame 12. As shown in FIG. 5, ball bearings 108 are disposed between the linear bearings 96, 102. The linear bearings 96, 102 aid in supporting the plate holder 20 between the sides 106 as well as allow the plate holder 20 to slide in a generally horizontal direction.

Bolted to one end of the plate holder 20 is a ball nut mounting bracket 110 that has an opening 112 in which a ball nut 114 is mounted. The ball nut 114 is threadably coupled to the lead screw 90. The lead screw 90 is mounted to the main frame 12 in a manner similar to that of the lead screw 36 for the pad holder 16. In particular, the lead screw 90 is provided with a reduced diameter portion which extends through a bore 116 in a support bracket 118 that is part of the main frame 12. Two flange bearings 120, 122 positioned on either side of the bore 116 support the lead screw 90 and allow the lead screw 90 to freely rotate within the bore 116. The opposing end of the lead screw 90 is fixedly secured to a notched pulley 124 having a side surface 126. The side surface 126 of the notched pulley 124 and the shoulder 128 formed by the reduced diameter portion on the lead screw 90 engage the respective flange bearings 120, 122, thereby preventing lateral movement of the lead screw 90.

Extending around the notched pulley 124 is a closed-looped timing belt 130 that also extends around a drive pulley 132 drivingly coupled to the stepping motor 28. Activation of the stepping motor 28 causes the lead screw 90 to rotate such that its helical gear teeth 134 engage inner threaded portions of the ball nut 114 causing the ball nut 114 to move in a horizontal direction along the lead screw 90. As the ball nut 114 moves along the lead screw it pulls the mounting bracket 110 and the plate holder 20 in a horizontal direction.

As with the pad holder 16, the plate holder 20 may be provided with a conventional contact switch for sensing when the plate holder 20 is in its fully retracted or "home" position. A home vane 138 (FIG. 6) may be mounted to the mounting bracket 110 and a home switch block 140 mounted to the main frame. When the plate holder 20 is in a retracted position, the home vane 138 engages the home switch block 140, thereby closing a circuit and producing a signal that the plate holder 20 is in its retracted position.

The combination of the lead screws and stepping motors allows for very precise positioning of the pad holder and plate holder. The stepping motors 26, 28 of the drive assemblies 34, 88 and the lead screws 36, 90 may be of conventional design. An example of a suitable stepping motor is a Model No. 5023-149 stepping motor that is available from Applied Motion Products, Inc. of Scotts Valley, Calif. The stepping motor has a holding torque of approximately 140 oz-in and is capable of 200 steps per revolution. A suitable pitch for the lead screws is approximately two threads/in (0.79 threads/cm), which enables each ball nut to move approximately ½ in (12.7 mm) per revolution of the respective lead screw. The gearing between the stepping motors and the lead screws preferably is sized so that it takes approximately 9.186 steps of the stepping motors to move either the pad or plate one millimeter.

With such a lead screw/stepping motor combination, error in stepping motor repeatability is approximately 3%, this error being noncumulative. Accordingly, the degree of accuracy is approximately 3%×(1 mm/9.186 steps) or approximately 0.0033 mm of linear error (noncumulative). This degree of accuracy is on the order of at least one magnitude or more than other drive systems currently on the market.

FIGS. 7–14 illustrate a preferred embodiment of an inking assembly 150 for supplying ink to the engraved area of the printing plate in accordance with the present invention. The inking assembly 150 includes an ink cup 152, an ink cup holder 154 for removably holding the ink cup 152, and a clamping assembly 156 for removably holding the ink cup holder 154 and ink cup 152 within the main frame 12 of the printing machine 10 and for applying a doctoring force, as explained further below, to the holder 154 and ink cup 152. The ink cup 152 is preferably a shallow cylindrical member that is open on one side 158 and comprised of steel, hardened to approximately 47–50 HRC. The ink cup 152 has a machine-finished rim 160 that functions as a doctoring blade to scrape excess ink from the printing plate 22. The cup may comprise other suitable materials that enable the cup to be magnetically attracted and that at least in the area of the rim 160 are sufficiently hard to provide a good doctoring edge.

The cup holder 154 is a plate-like member having a recess 162 for receiving the ink cup 152. When the ink cup 152 is positioned within the recess 162, the doctoring rim 160 protrudes at least slightly from the holder 154. Disposed about the cup holder recess 162 are a plurality of pockets 164 for removably receiving a plurality of magnets 166. The magnets 166 are held within the pockets 164 by retainer rings 168. Preferably, the pockets 164 and magnets 166 are disposed on the opposite side of the holder 154 from the recess 162 and ink cup 152 so that the magnets 166 are better isolated from ink held in the ink cup 152. For clarity, throughout the specification the side 170 of the cup holder in which the magnets are disposed will be referred to as the "top" of the cup holder and the side 172 in which the recess 162 is disposed will be referred to as the "bottom." Preferably, the ink cup holder 154 comprises aluminium or other suitable material. The magnets 166 disposed in the pockets 164 of the cup holder 154 are preferably strong enough to attract the ink cup 152 and retain it within the recess 162 without the need for separate clamps or coupling devices. A hole 174 may be provided in the top 170 of the holder 154 to allow easy access to the ink cup 152. Once the ink cup 152 is positioned in the recess 162, it becomes magnetized due to the magnetic properties of the steel. Although the magnets 166 are preferably removable from the cup holder 154, the magnets 166 could be fixedly embedded in the holder. Furthermore, whereas four separate magnets 166 and pockets 164 are shown, more or less magnets could be employed and positioned at different locations in or on the holder. For example, a single magnet could be disposed on the top 170 of the ink cup holder directly behind the ink cup.

In addition to holding the ink cup 152 in the recess 162 of the ink cup holder 154, the magnets 166 serve to hold the ink cup 152 in engagement with a printing plate 22 having an engraved legend or image for receiving ink. The printing plate 22 is preferably made of a material that is attracted to the magnets 166 and the magnetized ink cup 152 and is provided with an etched image. Due to the magnetic attraction, the printing plate 22 is held firmly against the rim 160 of the ink cup 152 such that the ink cup 152 and printing plate 22 define a closed reservoir for holding ink. The magnetic attraction created by the magnets 166 is preferably strong enough to hold the ink cup 152 in sealing contact with the printing plate 22 so that ink can not escape from the reservoir. To fill the ink cup 152, preferably the ink cup 152 is positioned in the cup holder recess 162 with the bottom side 172 of the cup holder facing upwardly, and the ink cup 152 is filled with ink. The printing plate 22 may then be positioned over the ink cup 152, thereby sealing the ink cup 152 closed.

Figure 6:
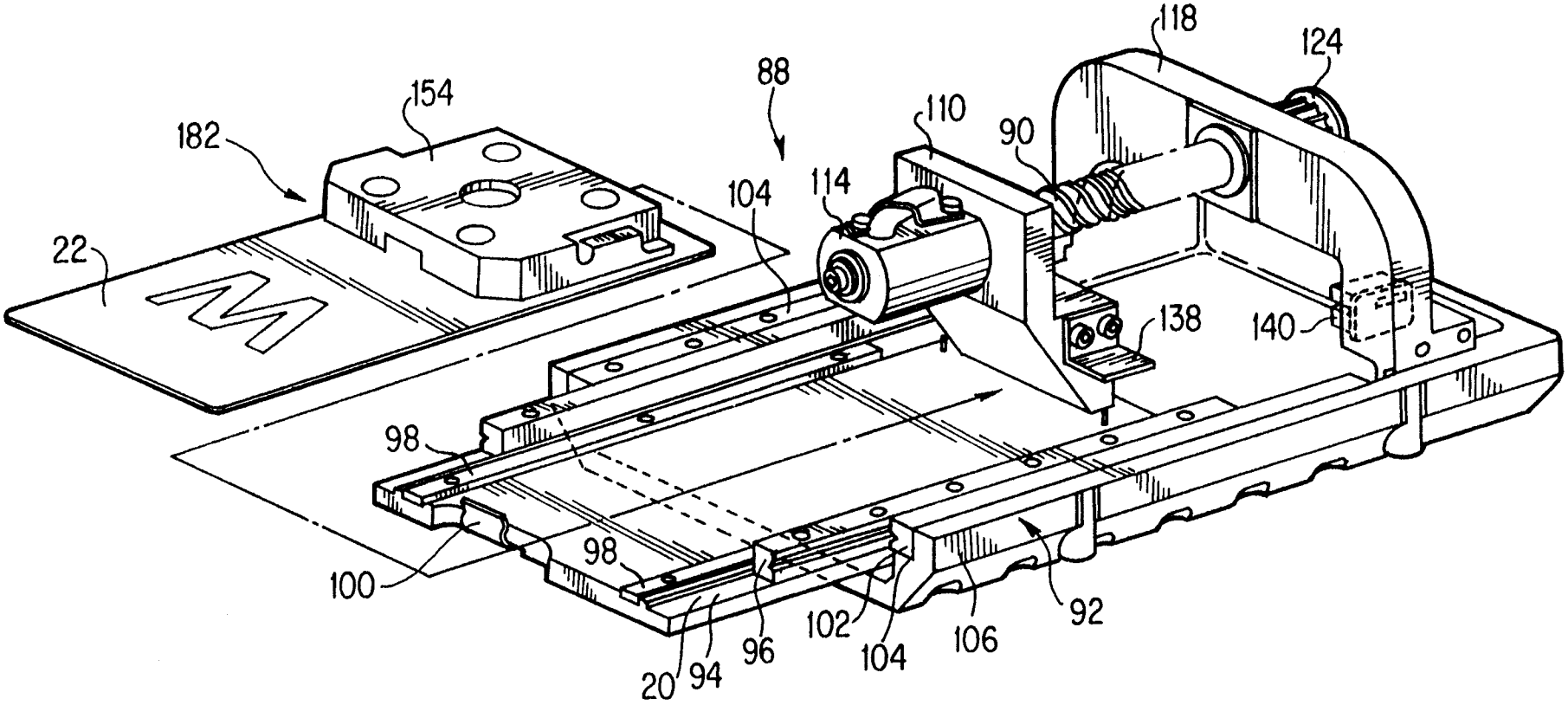
FIG. 6 is a perspective view of the plate holder drive assembly of the pad printing machine of FIG. 1 and of an ink cup assembly in accordance with the present invention.
Figure 7:
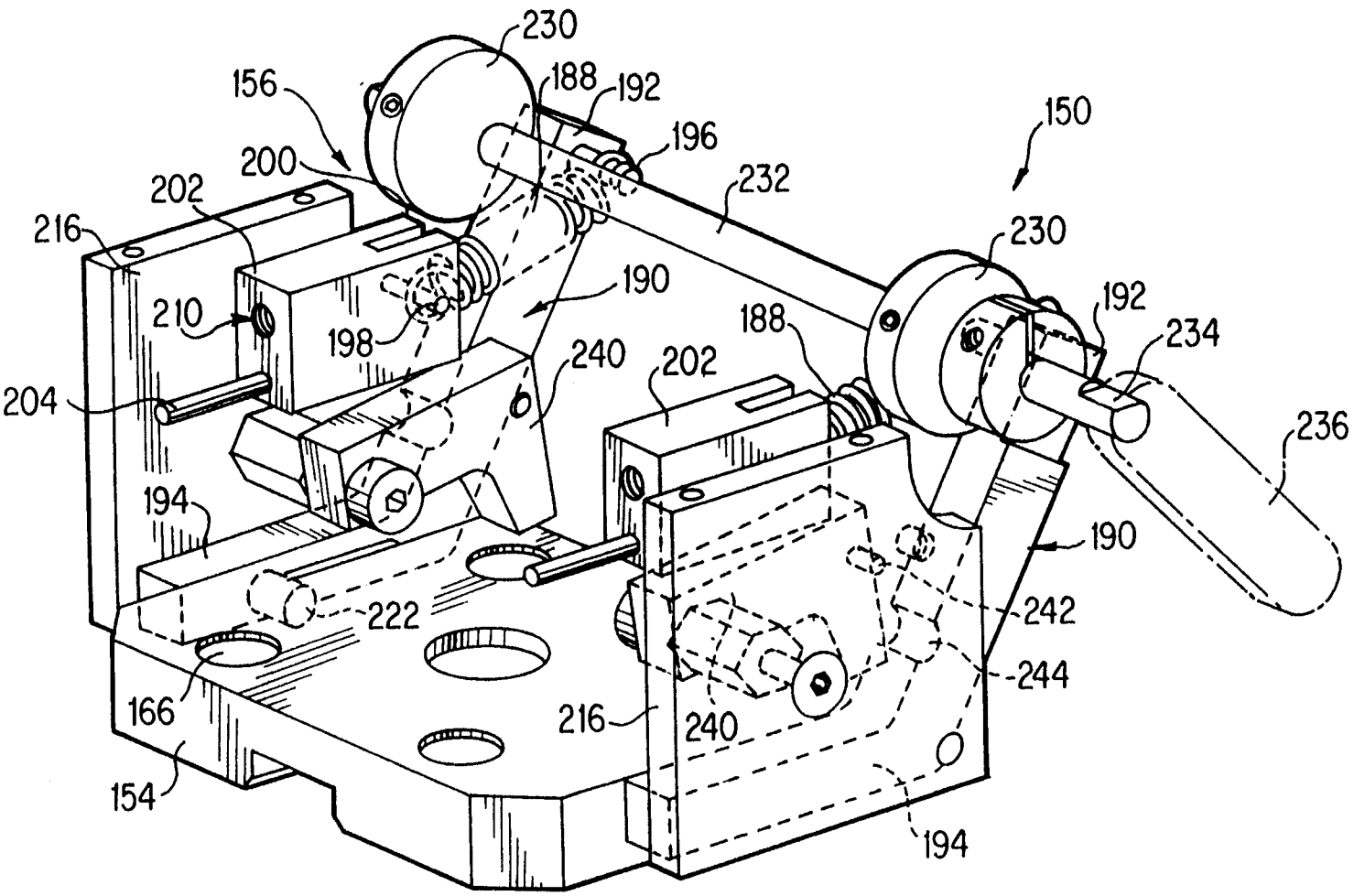
FIG. 7 is a perspective view of the inking assembly of the present invention.
Figure 8:
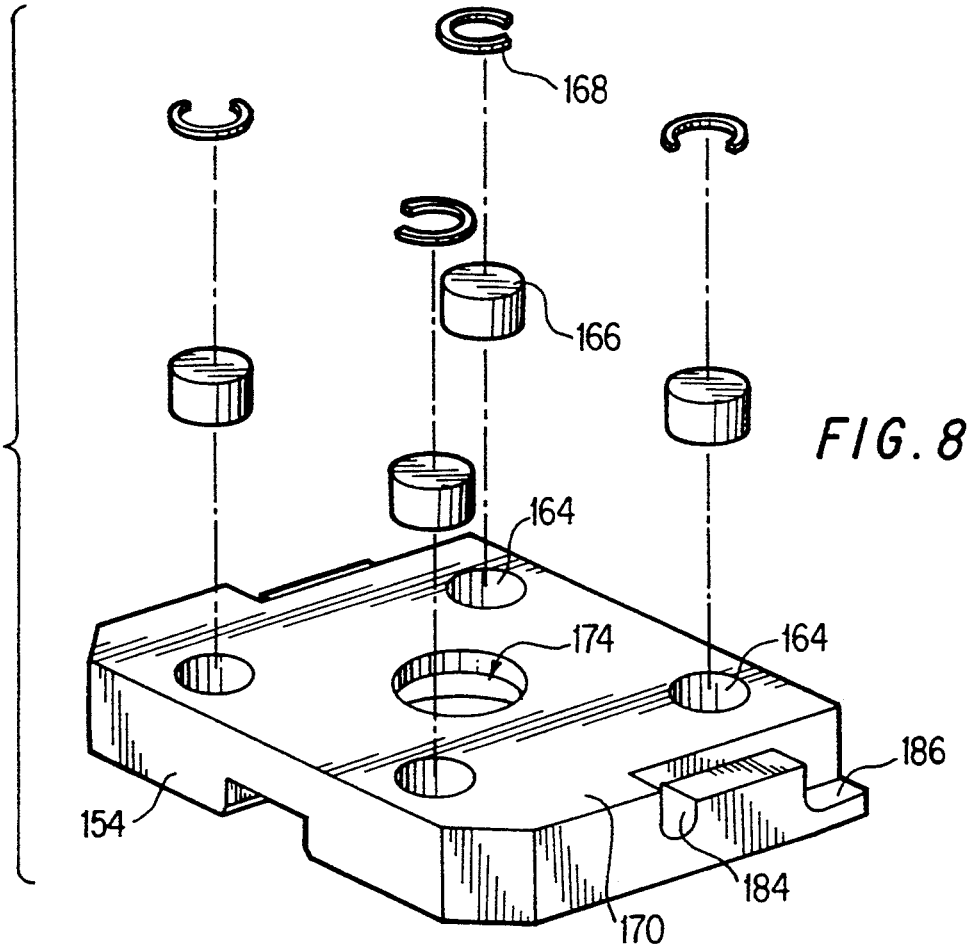
FIG. 8 is an exploded perspective view of an ink cup holder in accordance with the present invention.
Figure 9:
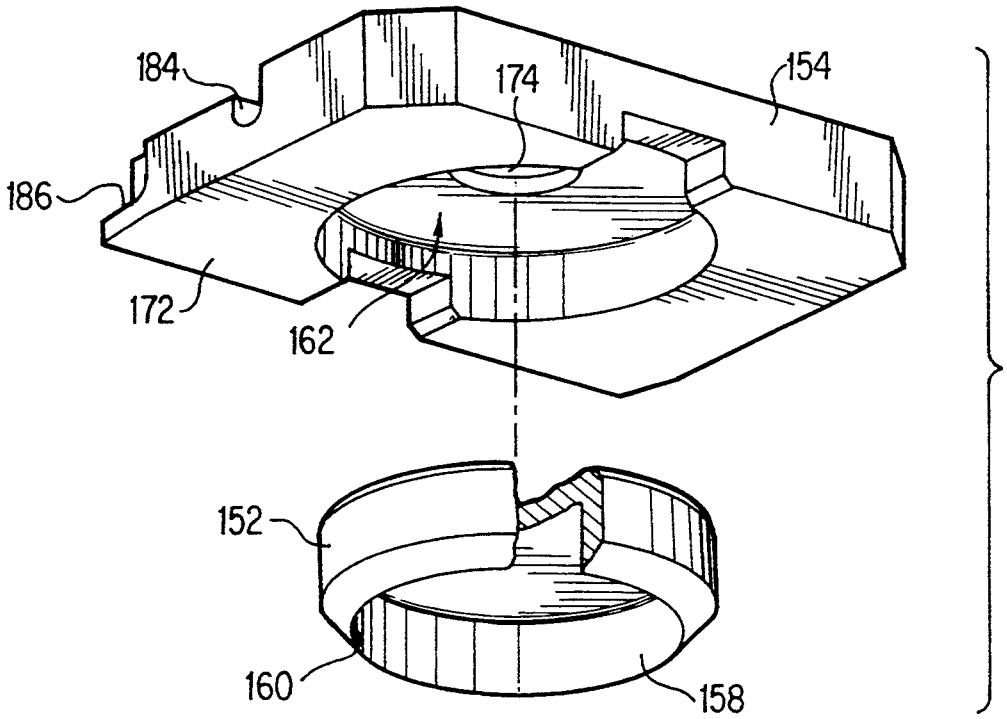
FIG. 9 is an exploded perspective view of the ink cup holder and an ink cup in accordance with the present invention.

With reference to FIG. 6, the ink cup 152, ink cup holder 154, and printing plate 22 may then be moved as a unit 182 and positioned within the printing machine 10. Due to the protrusion of the ink cup rim 160 from the cup holder 154, the cup holder 154 does not contact the printing plate 22. This assures that the cup holder 154 will not damage the printing plate 22 during printing when the printing plate 22 is moved back and forth beneath the ink cup 152. To add or replace the ink in the ink cup 152, the unit 182 may be withdrawn from the machine 10 and the printing plate 22 removed from contact with the ink cup 152 in order to expose the inside of the ink cup 152. Alternatively, separate units of ink cup holders, ink cups, and plates holding different types of inks can be placed in storage and retrieved when a specific type of ink is needed.

Figure 10:
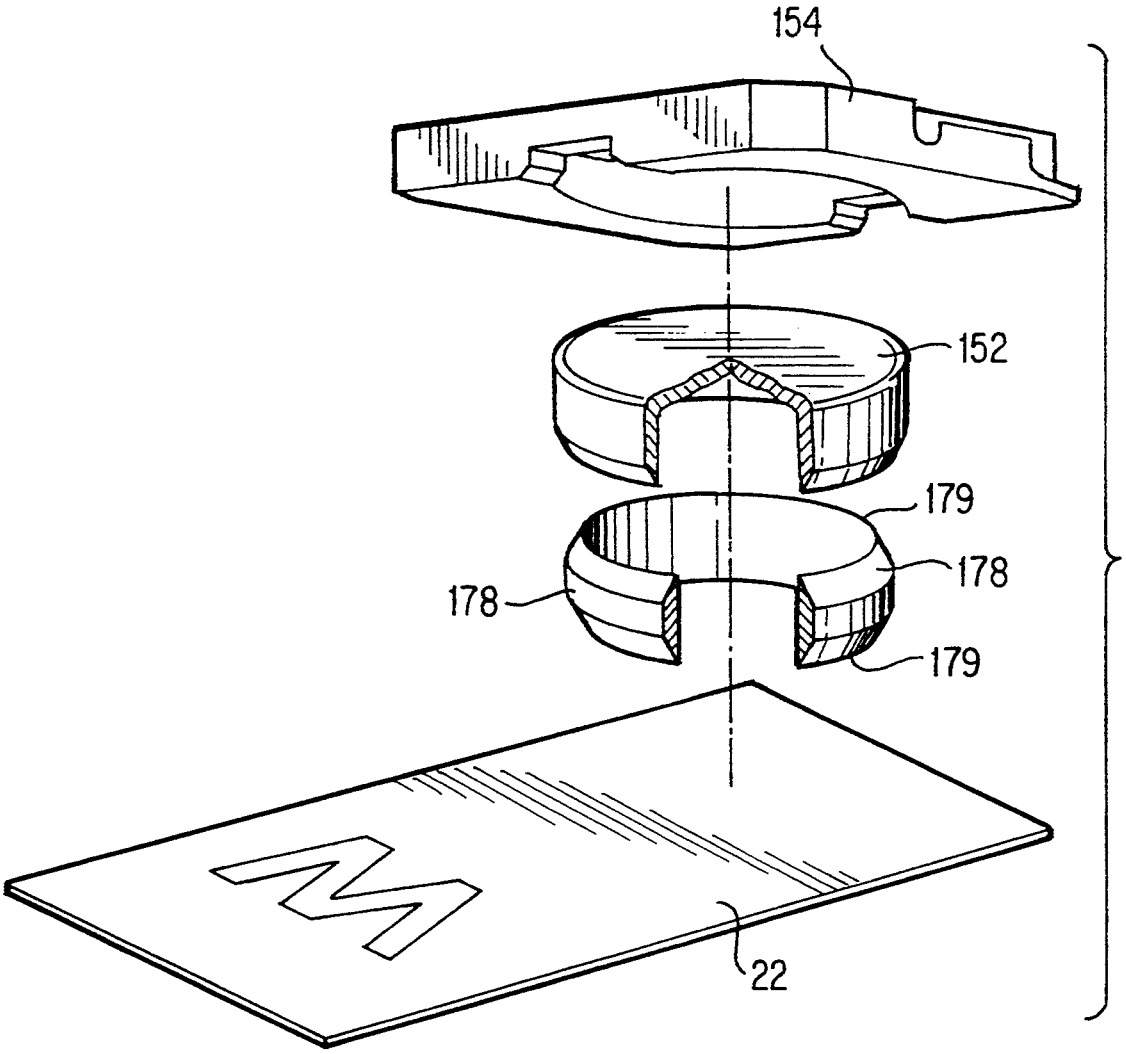
FIG. 10 is an exploded perspective view of the ink cup holder and ink cup of FIG. 9 and a doctoring ring in accordance with the present invention.

With reference to FIG. 10, a separate doctoring ring 178 may be provided that can be removably positioned within the ink cup 152. The doctoring ring 178 preferably has two opposing doctoring edges 179. When one edge becomes worn, the ring 178 can be removed and inverted so that the other edge can function as a doctoring edge. In this manner, the life of the ink cup 152 can be extended.

When the unit 182 is placed in the printing machine 10, the printing plate 22 is positioned on the plate holder 20, and the cup holder 154 and ink cup 152 are further pressed against the printing plate 22 by the clamping assembly 156. The clamping assembly 156 engages grooves 184 disposed on opposite sides of the ink cup holder 154 and applies a downward force created by a pair of springs 188. The force of the springs 188 is transmitted to the cup holder 154 by respective pivot links 190. The pivot links 190 have a generally L-shape with an upper leg 192 and lower leg 194. Referring to only one side of the clamping assembly, with the understanding that the other side is the same, one end of the spring 188 is removably hooked to a pin 196 extending from the upper leg 192 of the rocking link 190. The other end of the spring 188 is removably hooked to a pin 198 on a first end 200 of an adjustment block 202.

A guide pin 204 protrudes from an opposite second end 206 of the adjustment block 202 and is slidingly received through a hole in a support plate 208 that is bolted to the main frame 12. The second end 206 of the adjustment block also has a threaded bore 210 for receiving an adjustment screw 212. As shown, the adjustment screw 212 is threaded through a hole in the support plate 208 and into the bore 210 of the adjustment block 202. Turning of the adjustment screw 212 causes the adjustment block 202 to move either toward or away from the support plate 208, thereby varying the bias of the spring 188.

The pivot link 190 is pivotably mounted to a side plate 216 substantially at the juncture of the upper and lower legs 192, 194 by a shoulder screw 218 having a cap. Located on the lower leg 194 of the pivot link 190 is an inwardly facing pin 222. This pin 222 engages groove 184 of the cup holder 154 when the cup holder 154 is positioned in the printing machine 10. The spring 188 is preferably biased so as to apply a pulling force on the upper leg 192 of the pivot link 190 in a direction indicated by arrow 224 thereby causing a downward bias of the lower leg 194 in a direction indicated by arrow 226. If the ink cup holder 154 and ink cup 152 are positioned in the machine, a downward bias is applied by the pin 222 on to the cup holder 154. The strength of the downward bias of the lower leg 194 may be modified by turning the adjustment screw 212. Turning the adjustment screw 212 so that the adjustment block 202 moves toward the support plate 208 increases the downward bias of the lower leg 194. Rearward grooves 186 may be provided on the ink cup holder to provide clearance as the holder and cup are positioned in the machine.

The clamping assembly 156 includes two disks or cams 230, one corresponding to each pivot link 190, that are eccentrically mounted to a shaft 232 to form an eccentric which converts the circular motion of the shaft 232 to back-and-forth motion. The ends of the eccentric shaft are pivotably attached to the main frame with one end 234 also being attached to an eccentric handle 236 which may be manipulated to turn the shaft 232 and disks 230. The handle 236 may be moved into a clamping position shown in FIG. 11, whereby the cup holder 154 and ink cup 152 are firmly held in the machine, and into a released position shown in FIG. 12, whereby the clamping assembly 156 no longer exerts a pressure on the cup holder 154 and ink cup 152 so that the cup 152 and holder 154 may be removed. When the handle 236 is in its clamped position (FIG. 11), the disks 230 are turned so that they do not contact the upper legs 192 of the pivot links 190. Consequently, the upper legs 192 may be pulled forward by the springs 188 causing the lower legs 194 to exert a downward pressure on the top of the ink cup holder 154. When the handle 236 is moved into the released position (FIG. 12), the shaft 232 is turned so that the disks 230 are brought into contact with the upper legs 192 of respective pivot links 190, causing the upper legs 192 to rock backward and the lower legs to rock upward so that the pins 222 no longer engage the grooves 184 of the cup holder 154 and the holder 154 can be withdrawn.

Before the cup holder 154, ink cup 152, and printing plate 22 are placed in the printing machine 10, the eccentric handle 236 is moved to its released position so that the lower leg 194 of the pivot link 190 is raised. The cup holder 154 may then be slipped into the machine 10 so that the forward groove 184 is positioned beneath the pin 222. The eccentric handle 236 may then be moved to its clamped position whereby the pin 222 pushes downwardly on the cup holder 154 under the force of the spring 188. The pressure exerted by the clamping assembly 156 should be sufficiently great so that the ink cup rim 160 can adequately doctor the printing plate 22 as the plate is drawn past the ink cup 152.

The clamping assembly 156 includes a pair of safety catches 240 that are freely mounted to respective side plates 216. The safety catches 240 prevent the lower legs 194 of the pivot links 190 from dropping down and possibly hitting the plate holder 20 under the force of the springs 188 when the ink cup 152 and holder 154 are withdrawn from the machine 10 and the handle 236 is inadvertently moved to its clamped position. Each catch 240 has a generally "L" shape and a pin 242 that extends outwardly from one side to engage a groove 244 provided on a respective pivot link 190. When the cup holder 154 is positioned in the machine 10, the top 170 of the holder 154 pushes one end of the safety catch 240 up so that the pin 242 does not engage the groove 244. When the holder 154 is removed, however, the weight of the catch 240 causes the same end to drop downwardly such that the pin 242 is caught in the groove 244 provided in the pivot link 190. Should the handle 236 be moved to its clamped position after the holder 154 has been withdrawn from the machine 10, the pin 242 prevents the pivot link 190 from further rotating under the influence of the spring 188 and contacting and possibly damaging the plate holder 20 or a plate 22 positioned on the holder. The safety catches 240 also prevent one of the pivot links from activating a switch (discussed below) and thereby sending a false signal that the holder is in place.

Figure 13:
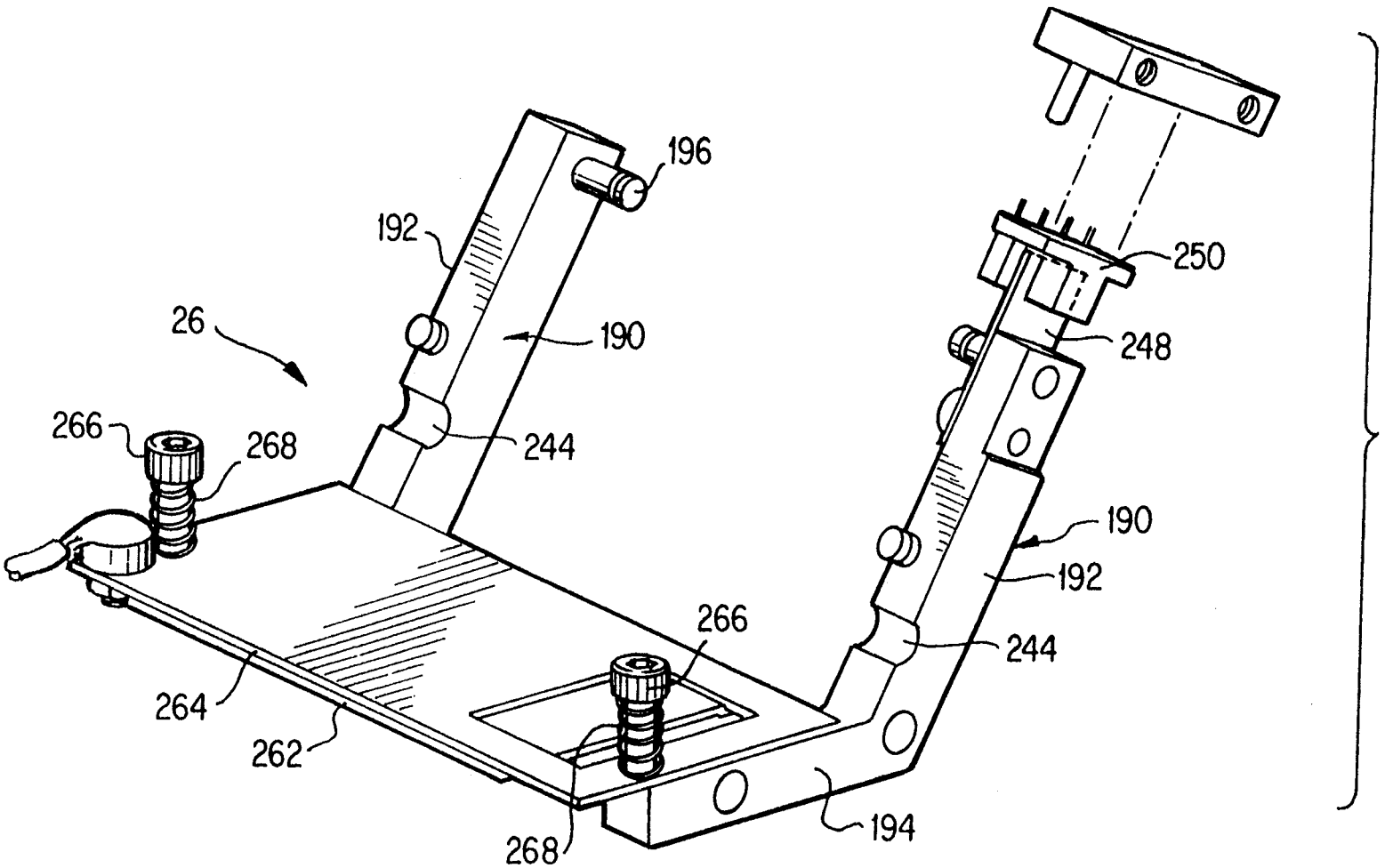
FIG. 13 is a perspective view of the heating assembly of the present invention.
Figure 14:
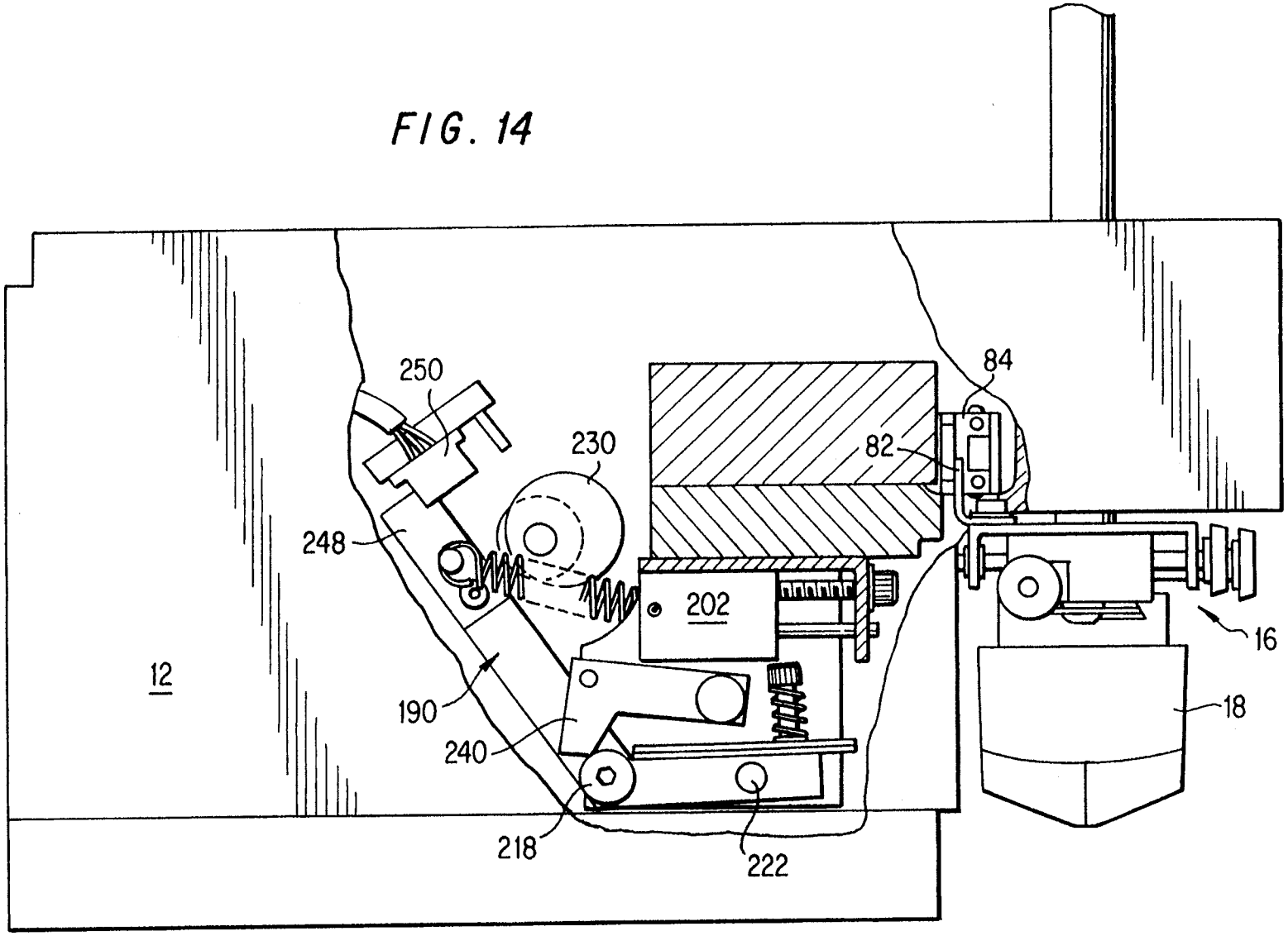
FIG. 14 is a side cut-away view of the printing machine of the present invention.

As shown in FIGS. 13 and 14, attached to the upper leg 192 of one of the pivot links 190 is a switch vane 248 that activates a block switch 250 when the vane 248 is brought into proximity with the switch 250. The switch vane 248 is carried into switching contact with the block switch 250 when the pivot link 190 is rotated into a clamping position. The block switch 250 then sends a signal to the control system signalling that the holder 154 is clamped in position.

The inking assembly 150 of the present invention has several advantages over conventional inking assemblies. The ink cup 152, ink cup holder 154 and printing plate 22 can be easily removed from the machine 10 as a unit without spilling of ink. More ink or a different type of ink can be added to the ink cup 152 without the need for manipulating the printing machine into a position that provides access to the ink cup. In addition, because the ink cup 152 is separate from the ink cup holder 154 and the clamping assembly 156, the cost of replacement would be significantly less should the doctoring edge become damaged or worn.

Figure 11:
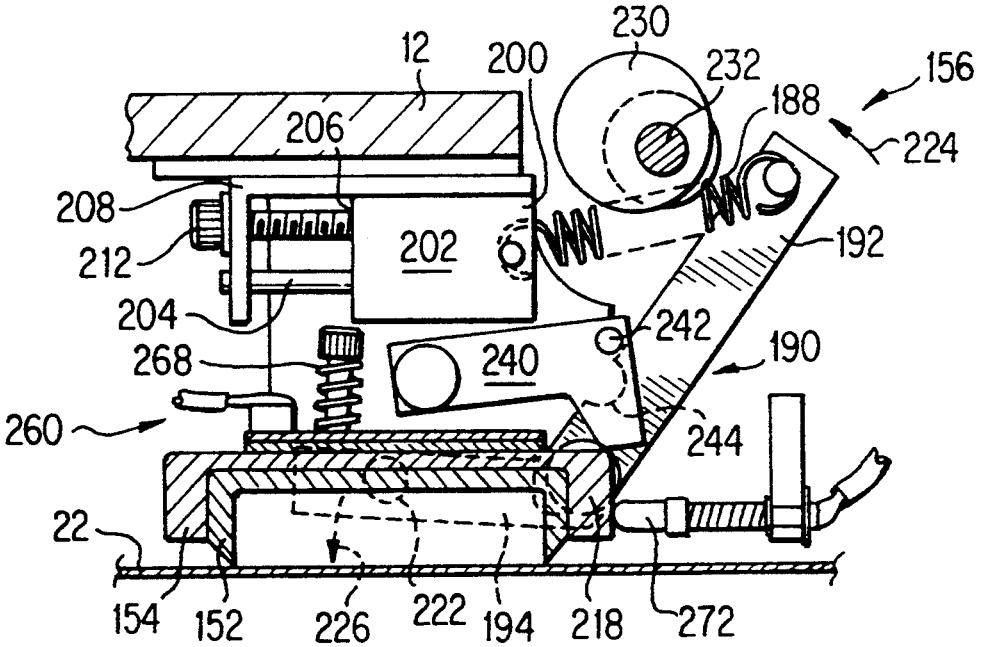
FIG. 11 is a side cross-sectional view of the inking assembly of FIG. 7 in a clamped position.
Figure 12:
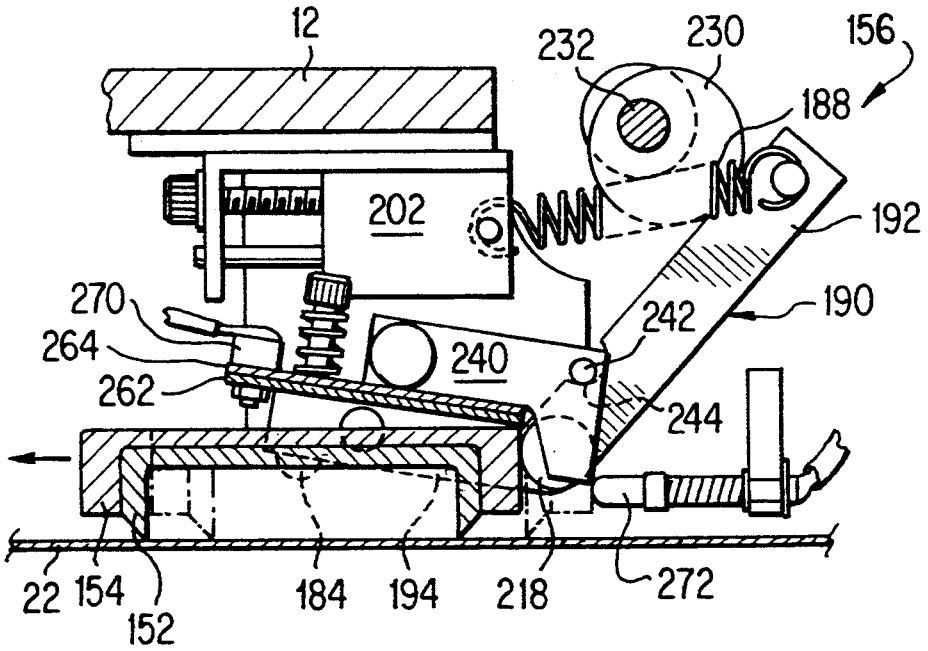
FIG. 12 is a side cross-sectional view of the inking assembly of FIG. 7 in a released position.

With reference to FIGS. 11–13, the inking assembly 150 may optionally include a heater assembly 260 for heating the ink held in the ink cup 152. By heating the ink, the ink viscosity decreases so that the ink may more rapidly flow into the etched areas of the printing plate 22. The more rapidly the ink fills the etched areas, the shorter the dwell time required for the engraved printing plate 22 to be positioned beneath the ink cup 152.

The heater assembly 260 includes a heater plate 262 and support plate 264 that are mounted to the lower legs 194 of the pivot links 190 by socket screws 266 and compression springs 268. When the ink cup 152 and ink cup holder 154 are positioned in the machine, the heater plate 262 extends over the top of the holder 154. The heater plate 262 is brought into contact with the holder 154 when the eccentric handle 236 is moved to its clamping position and the lower legs 194 of the pivot links 190 engage the grooves 184. Attached to the support plate is a thermostat 270 that functions as a thermal switch to protect the heater plate from thermal runaway. A temperature probe 272 is preferably provided for measuring the temperature of the reservoir. Frictional heating due to the movement of the printing plate against the ink cup can increase the temperature of the ink in the reservoir so that further heating by the assembly may not be necessary for certain periods of operation. Activation of the heater assembly is preferably controlled by the control system described below.

The control system of the present invention allows a user to control a number of different process parameters relating to the printing process. These parameters include, but are not limited to the speed and length of each movement of the printing pad and printing plate, as well as the length of time the printing pad or plate is held immobile. The process parameters may also include other printing parameters such as those related to the control of machine accessories. Different types of printing pads, inks, printing plates, and articles may require adjustments to the printing process in order to optimize the printing performance. With the present control system, the user is given direct control over a number of printing parameters and can make the necessary adjustments to provide an optimum print. The control system, as explained in further detail below, also has the ability to automatically control the printing cycle time and load-matching of the stepping motors should any deviations in timing or motor load occur during the printing process.

With reference to FIGS. 15A–15F, the basic print cycle can be divided into several motions or steps. Before the print cycle begins, both the pad and plate are moved to their fully retracted or "home" positions so that their respective home sensors are activated. Using the home positions as a reference, the pad and plate are then moved to "resting" positions specified by a user to delineate the desired retracted positions that the pad and plate will move to during the printing cycle. In many circumstances it may not be desirable to return the pad and plate to their fully retracted positions.

Figure 15A:
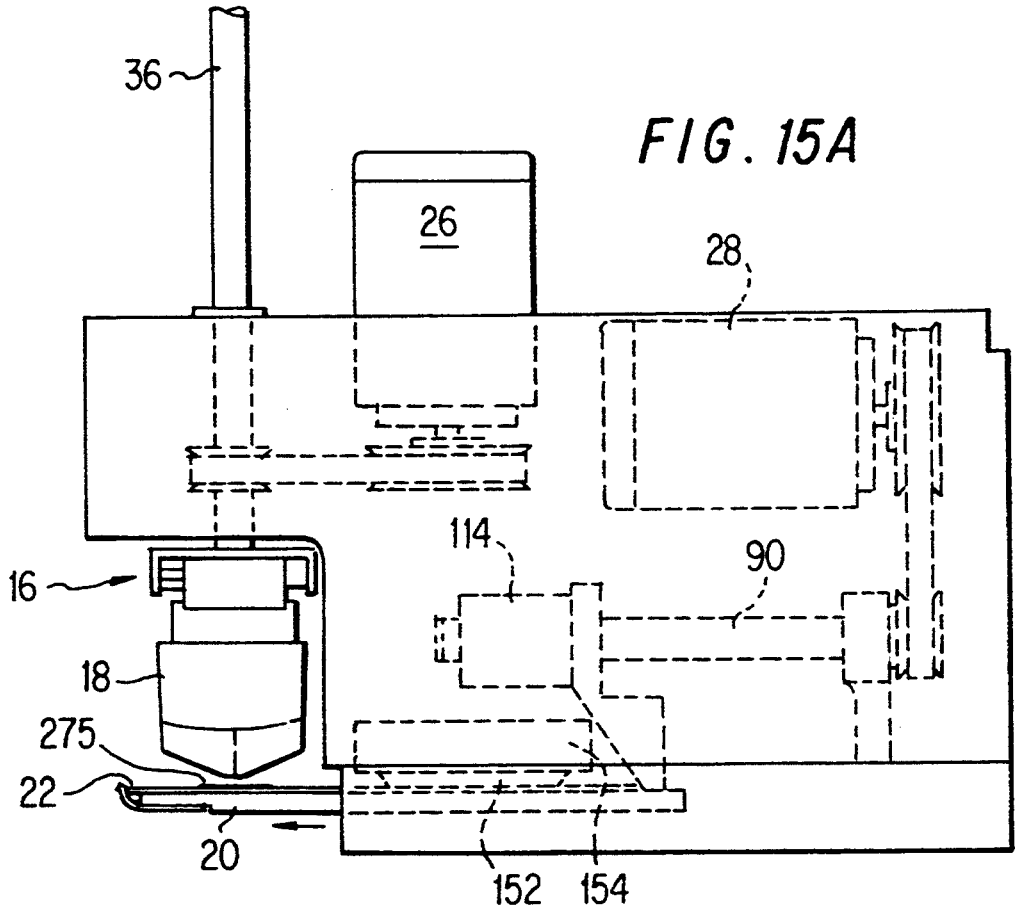
FIGS. 15A–15F illustrate in schematic the various steps of the printing cycle in accordance with the present invention.

Once the resting positions have been established, the print cycle may be initiated. The following are the various steps of the printing cycle:

Step 1: After reception of one of several possible triggering signals, the printing plate 22 is extended, making an inked image 275 available to the printing pad 18. (FIG. 15A)

Figure 15B:
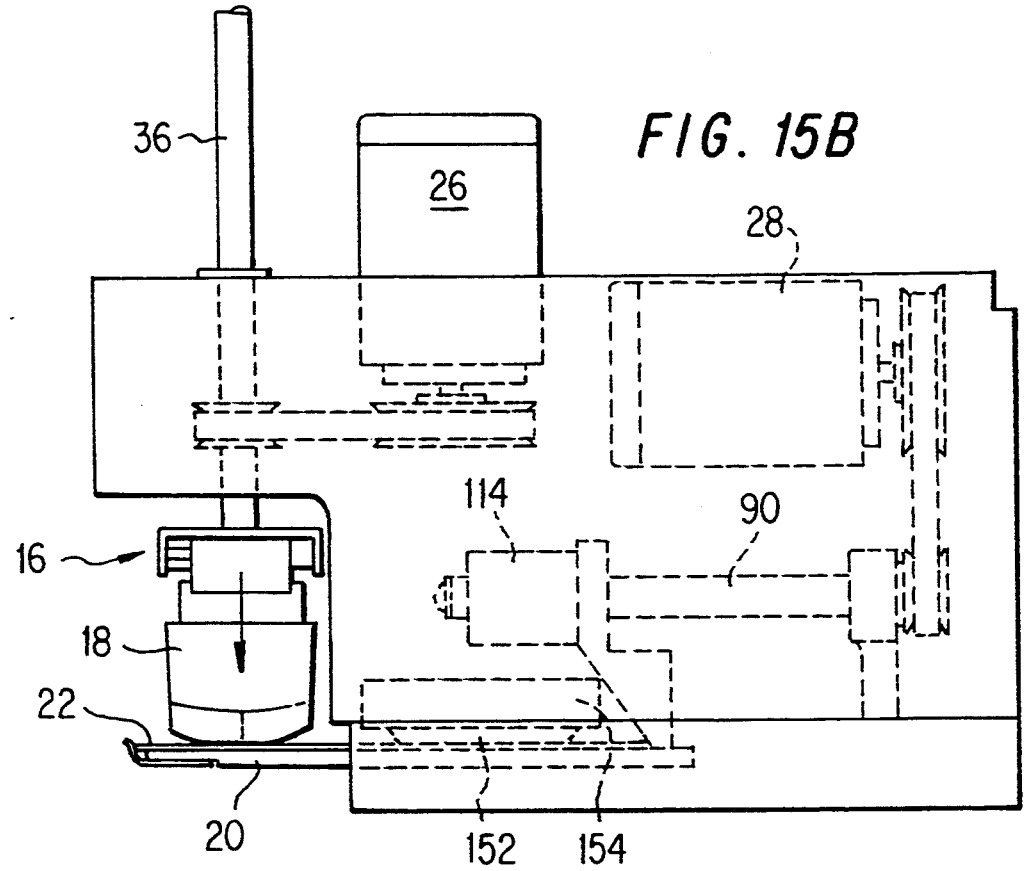

Step 2: The printing pad 18 is lowered to the printing plate 22 and is pressed over the inked image. (FIG. 15B)

Figure 15C:
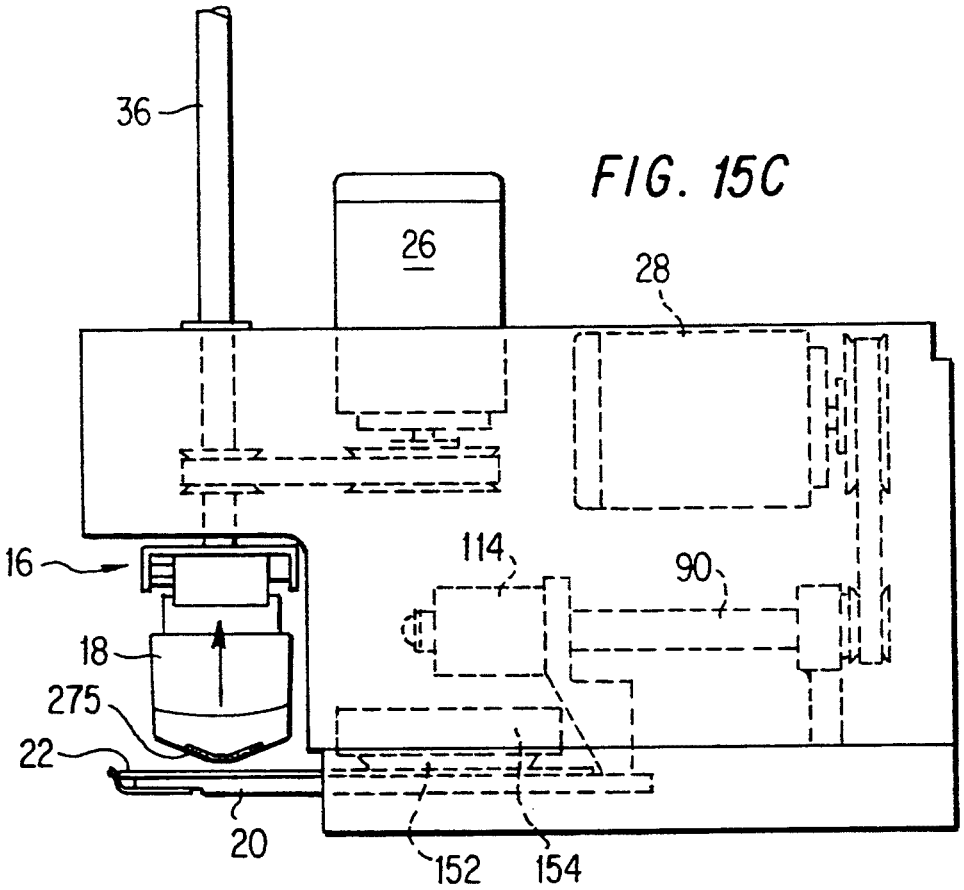

Step 3: The printing pad 18 is returned to its resting position, bearing the ink-film image 275. (FIG. 15C)

Figure 15D:
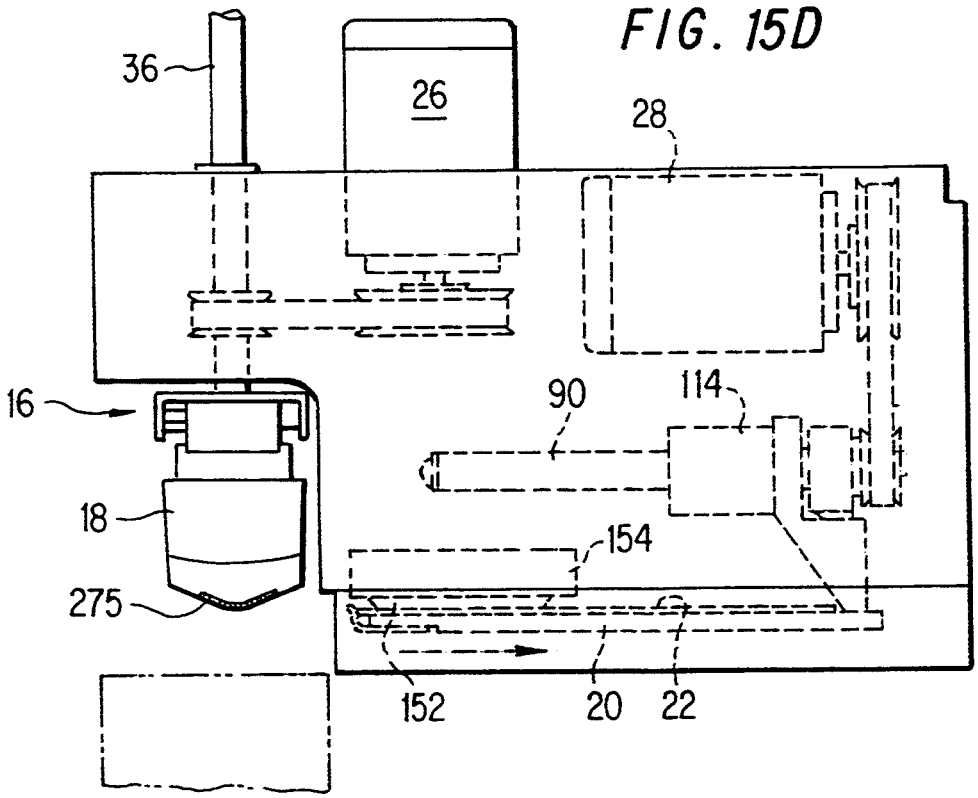

Step 4: The printing plate 22 is returned to its resting position for re-inking. (FIG. 15D)

Figure 15E:
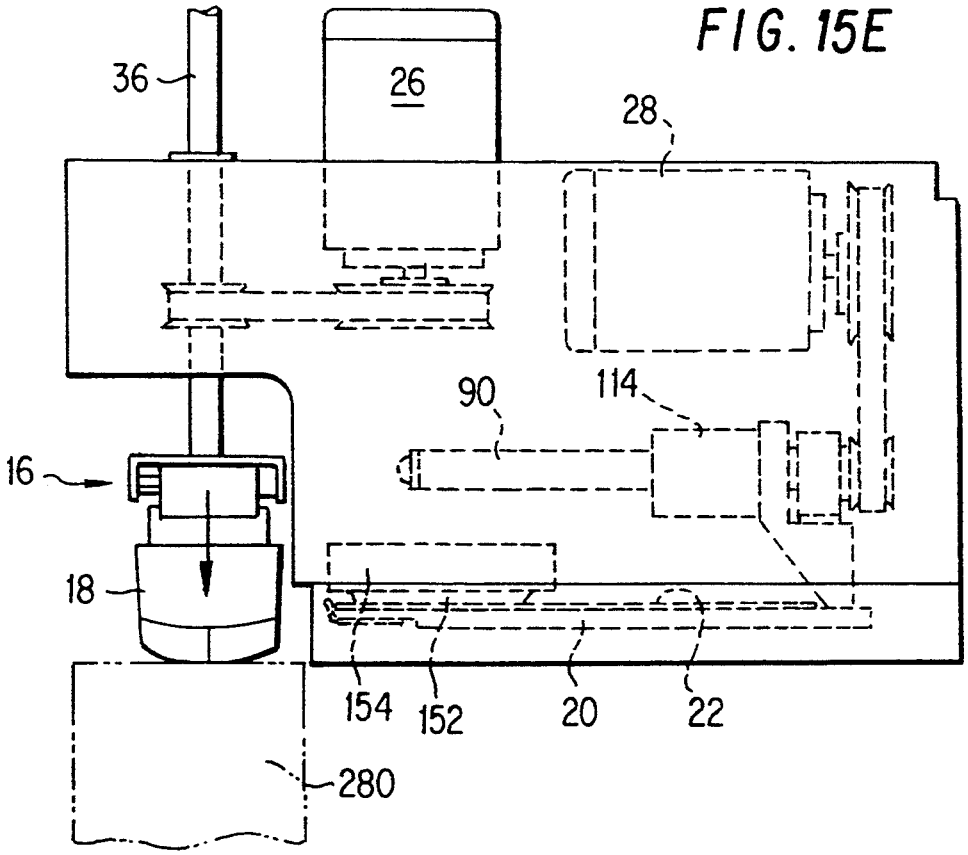

Step 5: The printing pad 18 is extended to the receiving surface of an article 280 to be marked and deposits the ink-film image thereon. (FIG. 15E)

Figure 15F:
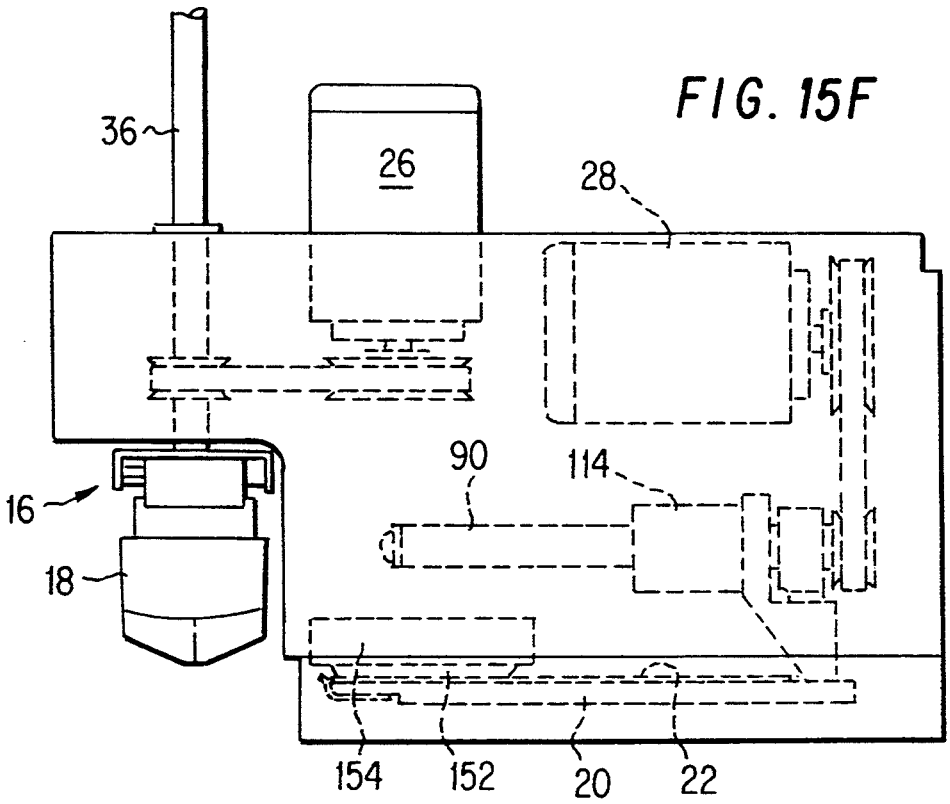

Step 6: The printing pad 18 is returned to its resting position, ready to begin the next cycle. (FIG. 15F)

Dwells, periods of time when the pad or plate is not in motion, are available after each step.

Figure 16:
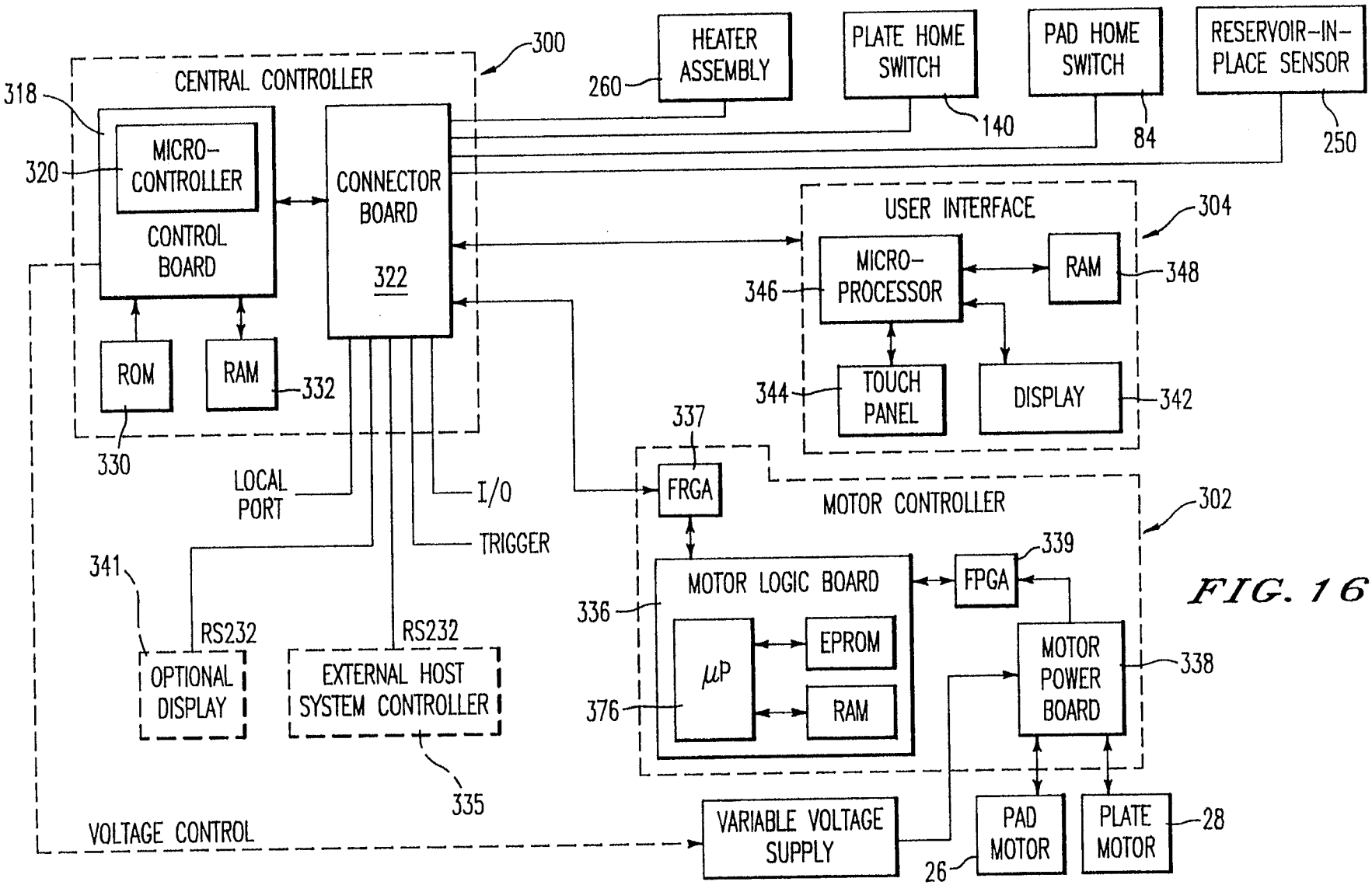
FIG. 16 is a block diagram of the overall control system of the present invention.

FIGS. 16 through 20 illustrate the control system for operating the printing machine 10 in accordance with the present invention. With reference to FIG. 16, the control system generally includes a central controller 300, a motor controller 302 which independently operates the stepping motors 26 and 28 based on commands from the central controller 300, and a touch-display user interface 304 that allows a user to input and modify different process parameters related to the print cycle or printing operation.

The central controller 300 controls each step of the basic print cycle described above by writing commands to and reading data from the motor controller 302. As will be described in further detail below, the commands instruct the motor controller to perform tasks such as rotating the stepping motors 26 and 28 a specific distance at a specific rate, pausing the operation of the motors, reading data from motor controller motion parameter registers and motion profile tables, writing entries to the motion profile tables, and setting motion parameter values. A list of the commands that may be sent by the central controller 300 to the motor controller 302 is provided as TABLE 1 further below. The motor controller 302 returns a response to the central controller 300 for every command received to indicate that processing of that command is complete. In addition, the motor controller 302 may provide asynchronous status messages at any time. The status messages may relate to the positions of the stepping motors 26 and 28 (and therefore of the pad and plate), stall conditions of the motors, and error messages when, for example, the command signals contain parameter data that is outside a predetermined range of values. A more complete list of the responses the motor controller 302 may send to the central controller 300 is provided in TABLE 2 further below.

In addition to controlling the motor controller 302, the central controller 300 is also in communication with the user interface 304. Via the user interface 304, a user can directly specify, among other process parameters, desired printing cycle parameters related to each step in the printing cycle. Such parameters may be based, for example, on the type of ink, the size and type of the printing pad employed, the size of the image to be printed, and the type of article to be printed. The particular printing cycle parameters that may be specified by the user are discussed further below with respect to FIG. 18 and are listed in TABLE 8 also further below.

Figure 17:
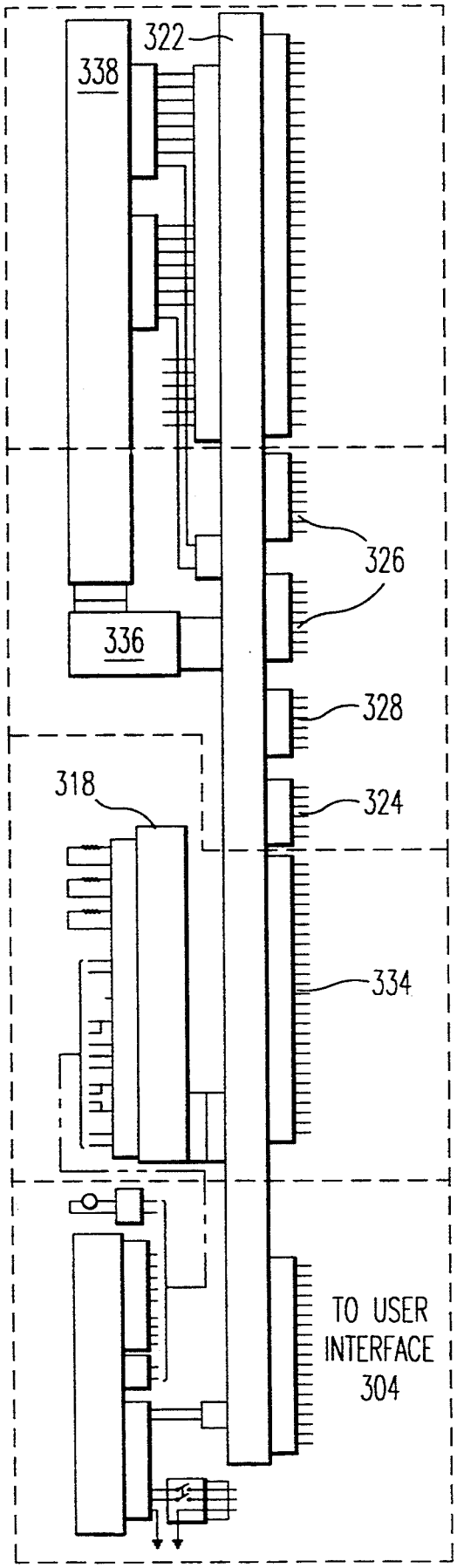
FIG. 17 is a schematic diagram of the central controller and motor controller.
Figure 17A:
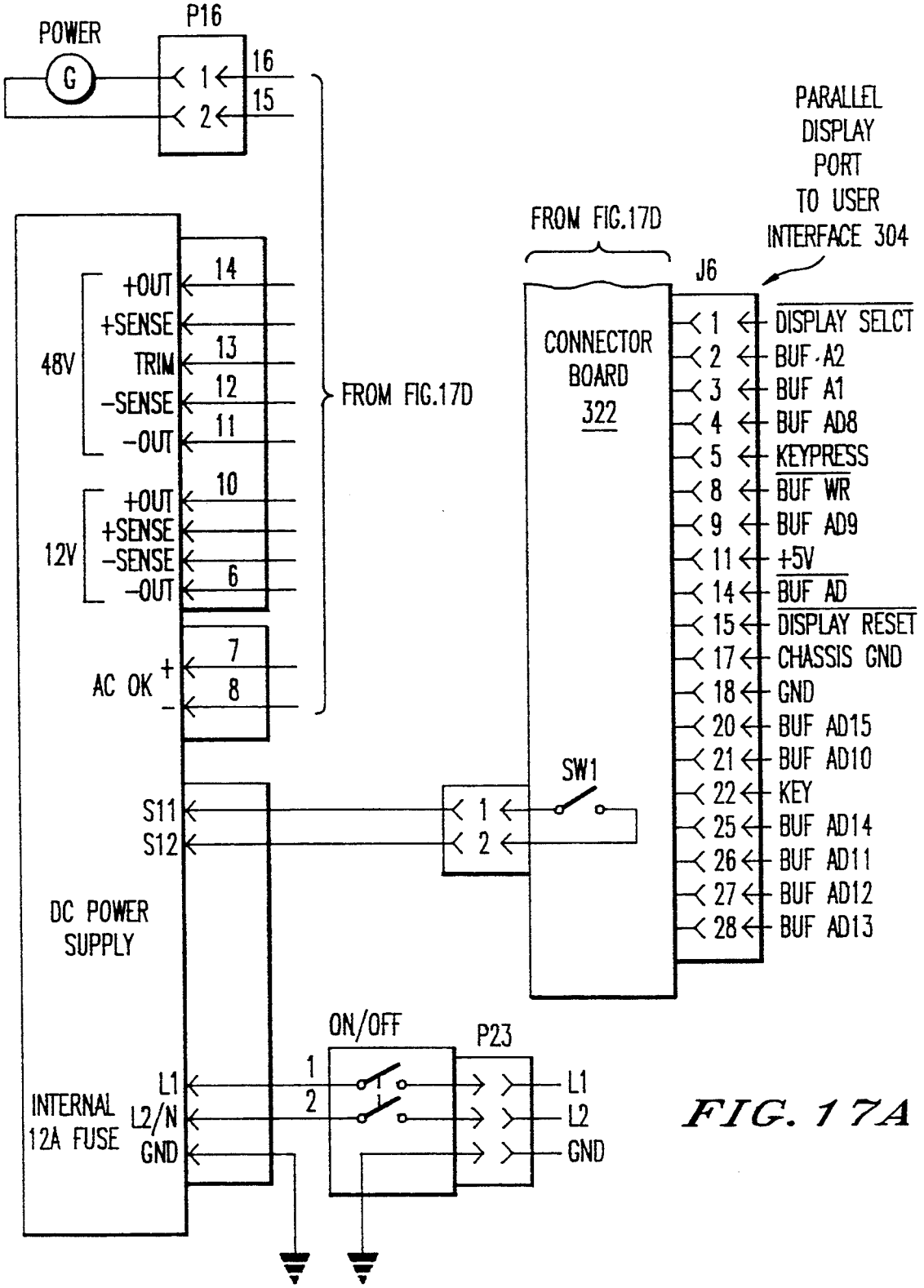
Figure 17B:
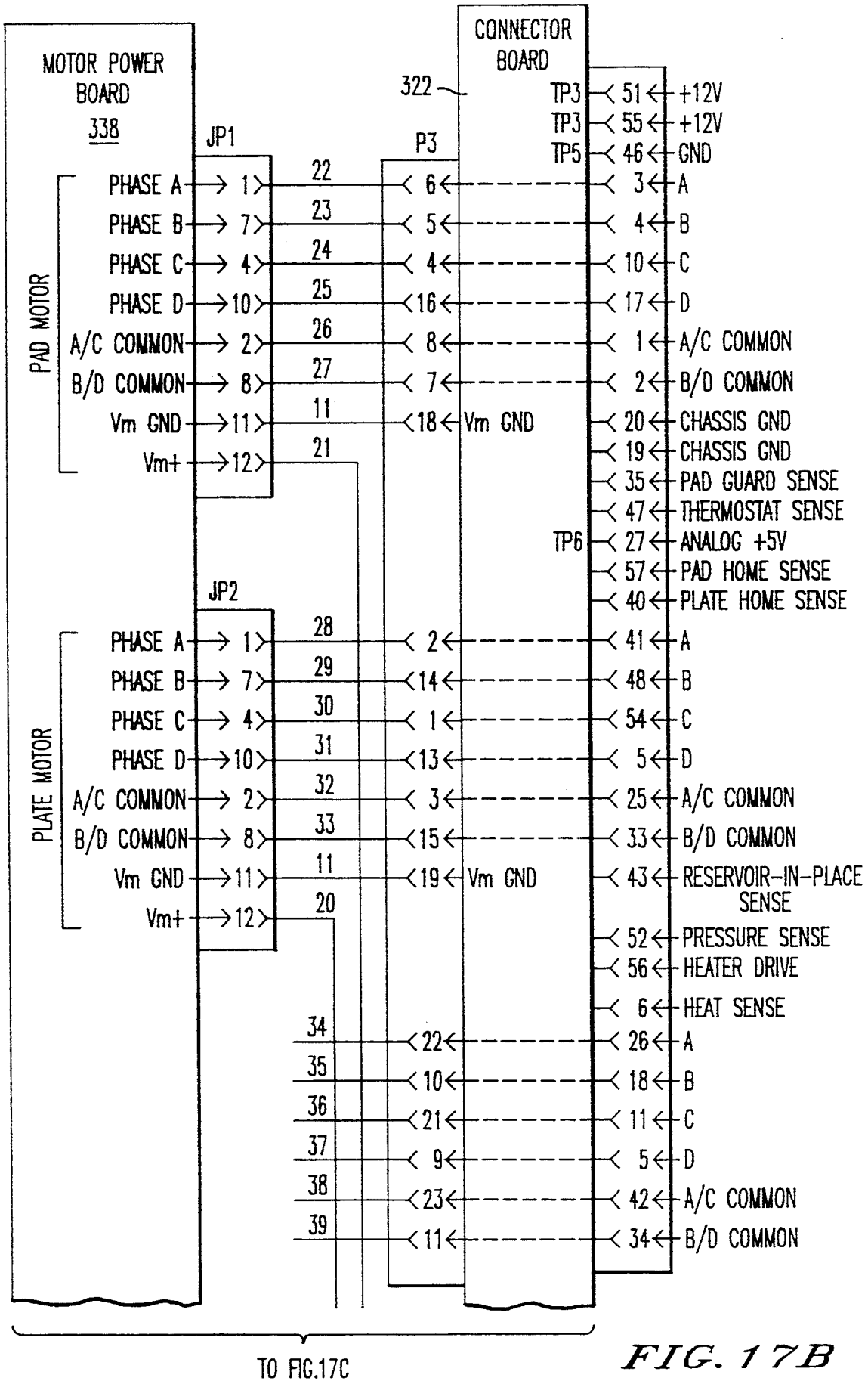
Figure 17C:
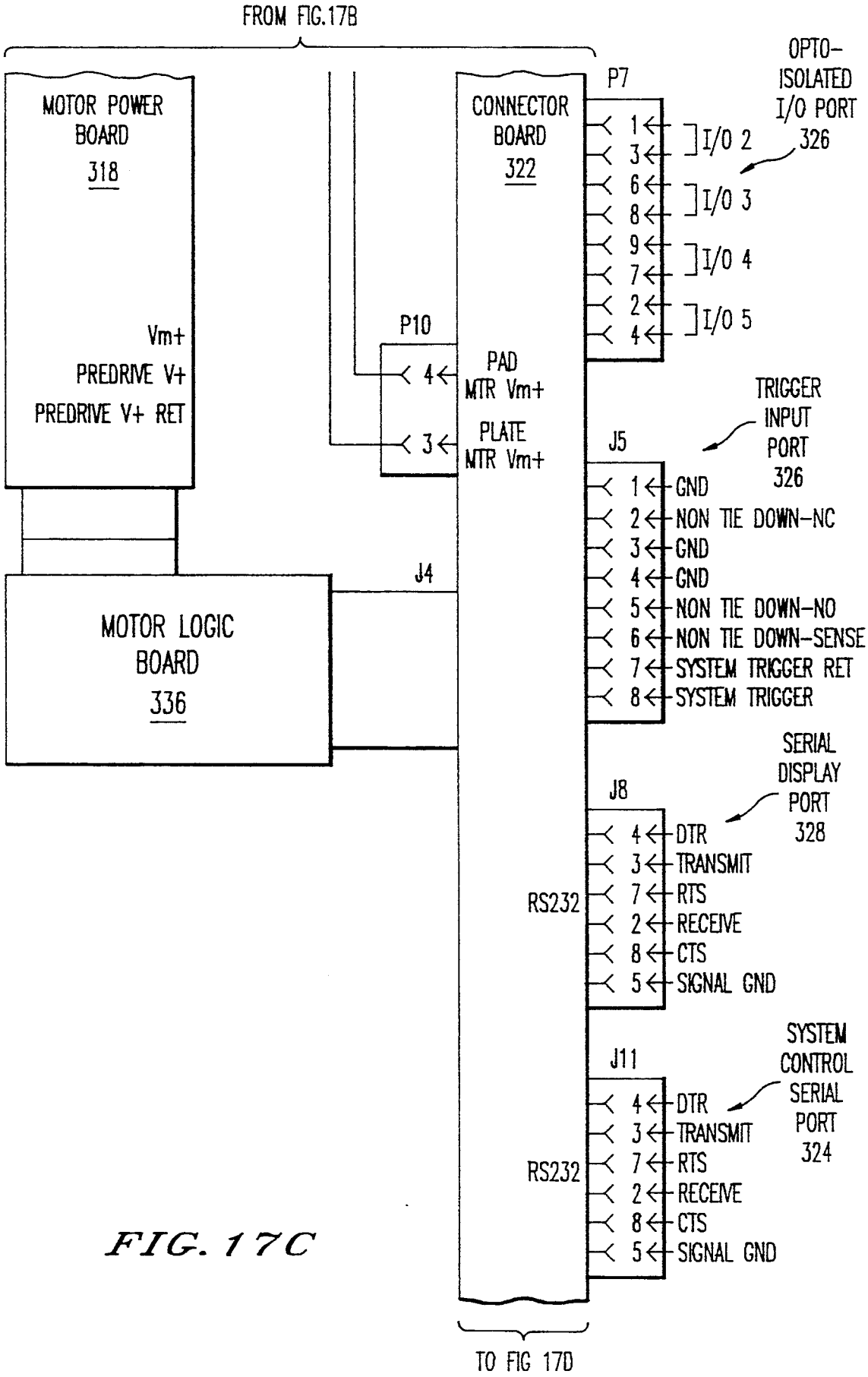
Figure 17D:
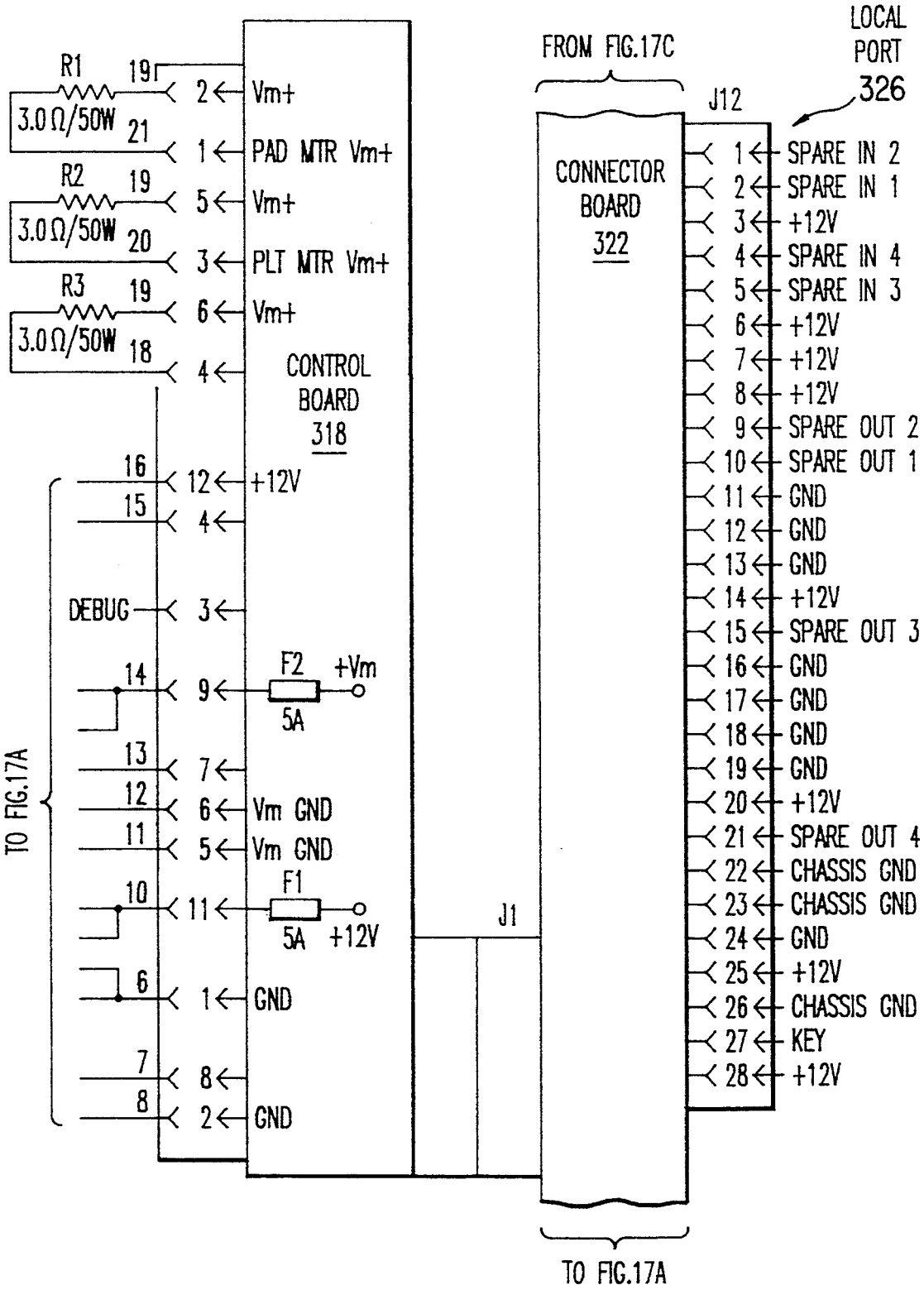

With reference to FIGS. 16 and 17, the central controller 300 preferably comprises two printed circuit boards. The first board, hereinafter called the control board 318, comprises measurement and control hardware including a microcontroller 320, as described in further detail below. The second board is a connector board 322 which provides an interface between the microcontroller 320 and the motor controller 302, the user interface 304, the pad and plate home switches 84, 140, the heater assembly 260, and the reservoir-in-place sensor 250, as well as selected external sources from which TRIGGER ("start cycle") signals and parameter data may be received. The connector board 322 preferably includes at least one system control serial port 324 such as an RS-232 communications channel for linking the microcontroller 320 to, for example, an external host controller 335. Both opto-isolated and local, non-isolated Input/Output (I/O) ports 326 are preferably provided for the transfer of TRIGGER input signals and BUSY output signals. Additional serial communication ports 328 allow for conventional signaling to occur between the central controller and, for example, a serial display device 341.

The pad printing machine 10 may operate in a number of different modes and as such may receive TRIGGER signals from a variety of sources. For example, the printing machine 10 may operate in a stand-alone mode where a user manually feeds articles to be printed to the printing machine 10. In this mode, the preferred interface to the central controller is a non-tiedown switch or other external switch in communication with the connector board 322 (I/O) ports 326 for delivering TRIGGER signals. Alternatively, the printing machine 10 could be coupled directly to an automatic handler that automatically feeds articles to the printing machine and sends TRIGGER signals via either the RS232 or external opto-isolating control line. In a further application, the printing machine 10 could be made part of a larger system, for example a system of multiple printing machines, that is under the control of an external host controller. This external controller via the serial port 324 can provide the necessary TRIGGER signals as well as input printing cycle parameters that might otherwise be delivered to the central controller 300 through the user interface 304. The TRIGGER signal may also be generated by the user interface 304 upon depression of selected keys on the interface by an operator or by an external switch. The connector board 322 can also accommodate relay closures which are employed in a number of pad printing applications. In these applications, status signals such as BUSY/-READY and CYCLE CLOCK can be returned to the external device by the central controller upon receipt of a TRIGGER signal, although the central controller is programmable to send other signals via the connector board.

The microcontroller 320 on the control board 318 is preferably an Intel 80186 microprocessor available from Intel Corporation of Santa Clara, Calif., although an operationally equivalent processor can also be used. The microcontroller 320 is coupled to a read-only memory (ROM) 330 and a random access memory (RAM) 332. The microcontroller 320 is programmed to process a number of signals received via the connector board 322 and send command signals to the motor controller 302.

Preferably, the motor controller 302 is of the type that uses back-EMF (electromotive force or voltage), that is induced in the stator coils of the stepping motor as the permanent magnet of the motor passes the coil windings, in order to commutate the stepping motors. The back-EMF provides an accurate indication of the position of the rotor within useful operating speeds of the motor. A motor controller of this type for controlling the operation of a single stepping motor is available from Magnon Engineering, Inc. of Rancho Cucamonga, Calif. as Magnon Part No. 10600. Further details of this motor controller can be found in U.S. Pat. No. 4,136,308, issued to Kenyon M. King on Jan. 23, 1979, entitled "Stepping Motor Control", and reissued as U.S. Pat. No. Re. 31,229 on May 3, 1983, both of which patents are expressly incorporated by reference herein. The motor controller of the present invention preferably is similar to that disclosed in U.S. Pat. No. 4,136,308 but has been modified to include more than one control circuit, corresponding to each stepping motor. In addition, the motor controller 302 preferably uses a more advanced microprocessor. With reference to FIG. 16, the motor controller 302 preferably comprises a motor control logic board 336 and a motor power board 338. The logic board 336 includes a microprocessor (preferably, Motorola Part No. MC68HC11F1 available from Motorola Semiconductor Products, Inc. of Austin, Tex.) 346, RAM, and erasable programmable read-only memory (EPROM), and the power board 338 includes the back-EMF commutation circuitry for controlling more than one stepping motor. The circuitry is similar to that disclosed in U.S. Pat. No. 4,136,308 but includes separate circuits for each of the stepping motors. The power board 338 is available from Magnon Engineering, Inc. as Part No. 11703, and the logic board 336 is available as Magnon Part No. 11700. The motor controller 302 also is provided with two field programmable gate arrays (FPGAs) 337, 339, one 337 which serves as interface between the logic board 336 and the central controller 300 and one 339 which serves as an interface between the logic board 336 and the power board 338. The (FPGAs) 337, 339 are available from Texas Instruments, Inc. of Houston, Tex. as Part Nos. TPC1010AFN-8068C and TPC1020AFN8068C, respectively. The FPGA 337 is programmed to implement logic necessary to affect major motor control functions, whereas the FPGA 339 is programmed to implement a logic interface between the microprocessor 346 and the central controller 300 as well as implement minor motor control functions.

The motor controller 302 includes a number of registers corresponding to different motion parameters for each motor channel. A list of the parameter registers can be found further below as TABLE 3. Several registers are read only (indicated with an "RO" label), whereas the remaining can also be set by the central controller 300. Of the parameters that can be set by the central controller, the holding-current duty cycle, the jog-hold duty cycle, the hold time, the jog-hold time, and the holding frequency are the parameters which control the detent torque and stiffness of motion for a particular motor. The minimum, maximum, and starting mask times are used as delay times to minimize the sometimes deleterious effects of spurious signals generated in the commutation circuitry due to switching of energized motor phases. The stall detect time is the maximum allowable period between commutation pulses above which a stall condition can be assumed. The base speed is the step rate used in an uncommutated movement (discussed further below), while the top speed is the desired speed used for the next commanded commutated movement. The crossover and maximum speeds, the unit-time, and the slope are used by the motor controller to generate ramp tables discussed below.

The motor controller 302 also stores a number of motion profile tables, that are listed further below as TABLE 5. These tables include first and last (uncommutated) step time tables that are input from the central controller 300. When a stepping motor starts and stops, it generally is rotating too slowly to generate a back-EMF signal. Consequently, a commutation signal cannot be generated for controlling the power flow to the coil windings. The first and last step time tables preferably include appropriate pulse sequences in microseconds for starting and stopping the motors. These tables may be determined empirically, input by the user, and referred to by the controller 302 whenever the stepping motors are operating in an open-loop mode, i.e. an uncommutated mode.

The microprocessor 346 is programmed to calculate the ramp times table and the ramp distances tables. The controller 302 refers to the tables when operating the stepping motors 26 and 28. The ramp tables essentially represent acceleration curves corresponding to each of the motors. Using the cross-over speed, maximum speed, slope and unit-time motion parameters, the microprocessor calculates the two ramp tables. The cross-over speed and the maximum speed establish the ramp table extrema. The unit-time provides a time increment for the tables and can be set by the user. The slope is the percentage difference between velocities corresponding to sequential unit times. The ramp distance table contains a step count in each table entry, and the ramp time table contains target step durations in each table entry.

Thus, for given points on an ideal acceleration curve represented by a unit-time entry in the tables, the motor controller is operable to perform table look-up operations to retrieve target step times from the ramp times table and step counts from the ramp distances table that correspond to the step durations in the ramp times table. The motor controller operates the motors 26 and 28 to perform the number of steps in the amount of time specified by the entries in these two ramp tables. For example, the step duration and count is looked up by the motor controller for a point on an ideal acceleration curve. A motor is operated to commutate such that axis motion corresponds to the step duration and count. A unit-time clock is then incremented before the motor controller attempts to operate the motor in accordance with the step time and count specified by the next table entries. Progress of the motors is measured by the commutation signal generated by the back-EMF signal of the motor phases.

The motor controller 302 operates the stepping motors in accordance with motion parameters provided by the central controller 300 in command and data signals during initialization and throughout the print cycle. Command and data signals transmitted between the central and motor controllers to implement the print cycle are formatted as byte-wide numerical codes. The flow of these signals is preferably the sole interface between the central and motor controllers. The motor controller 302 is configured to appear as two bytes on two address lines to the central controllers. A read operation of a motor controller memory register designated by the first address byte provides the central controller with status information on the state of the interface, as well as information on the internal state of the motor controller. Another read operation using the second address byte transfers data from the motor controller to the central controller. A bit in the status byte specifies whether the first byte is the first byte of a response or of follow-on data. The central controller can also perform a write operation to a motor controller memory address specified in a first address byte in order to send a command to the motor controller. A write operation using a motor controller memory register designated in a second address byte sends data from the central controller to the motor controller in support of a previously transmitted command.

The commands generated by the central controller and transmitted to the motor controller comprise a command byte and zero or more parameter bytes. The command byte can instruct the motor controller, for example, to move a selected motor, and therefore the pad or plate associated therewith, to an absolute or relative position specified by the parameter bytes, and to slow down and stop the motor at a designated deceleration speed. The various commands and parameters are described below in connection with Tables 1 and 2, respectively. Upon receipt of a command signal, the motor controller can generate and transmit to the central controller a number of designated responses listed in Table 3. The motor controller preferably returns a response signal for every command received from the central controller to indicate that execution of the command is complete. For example, the motor controller can acknowledge that a command was received, send resulting data, as well as provide an error message, a number of which are listed in Table 4. The motor controller can also send asynchronous messages at any time during operation to indicate, for example, that an axis move command has been executed. The central controller monitors the read /RD, and interrupt request /IRQ control lines of the motor controller status register and sends commands with the write control line /WR to ensure that the pad printing machine control system and the motor controller do not lock up waiting for signals from each other.

TABLE 1

| COMMANDS | |
|---|---|
| NUMBER | NAME |
| 00 | No operation. |
| 01 | SET MOTION PARAMETERS |
| 02 | PAUSE |
| 03 | Move the motor to the absolute position (# of steps) |
| 04 | Move the motor to the relative distance (# of steps) |
| 05 | Read value |
| 06 | Miscellaneous commands<br>00 Restart the control program<br>01 Format the EEPROM<br>02 Ramp down and stop the motor<br>03 Emergency stop<br>04 Save motor strucure data to EEPROM<br>05 Restore motor structure data from EEPROM<br>06 Slew forward indefinitely<br>07 Slew reverse indefinitely<br>08 Enable IRQ<br>09 Disable IRQ<br>0A Recalculate the ramp tables |
| 07 | Write table entry |
| 08 | Read table entry |

TABLE 2

| RESPONSES | |
|---|---|
| NUMBER | NAME |
| 00 | Reset complete |
| 01 | Acknowledge response |
| 02 | Pause complete |
| 03 | Move complete |
| 04 | Table entry |
| 05 | Parameter data |
| 15 | Error message |

TABLE 3

| MOTION PARAMETER REGISTERS | |
|---|---|
| NUMBER | NAME |
| 00 | Base speed - Starting speed for the motor in open loop mode. Min=100 Max=2000 Def=500 |
| 01 | Run speed - Run speed of operating motor. Min=100 Max=20000 Def=10000 |
| 02 | Decel steps (RO) - Number of steps to decelerate from run speed to base speed and stop. |
| 04 | Current position of motor based on step size. |
| 05 | Holding current duty cycle (0–100%) Min=0 Max=100 Def=0 |
| 06 | Pause timer - The current state of the timer for the pause command. This is the same register for all of the motors. Min=0 Max=60000 Def=0 |
| 07 | Limit switch definition - The high order word defines the forward limit and the low order word defines the reverse limit. In each definition the high byte is a mask that defines which input(s) to use and the low byte defines the polarity of those inputs. |
| 08 | Unit time - This is the number of microseconds represented by each entry in the ramp table. Min=100 Max=15000 Def=1000 |
| 09 | Slope - The slope is defined as a percentage of the difference between the current speed and the maximum top speed. This percentage is applied to build each ramp table entry. Min=1 Max=10 Def=6 |
| 0A | Maximum run speed - Ramp tables will be built to allow run speeds up to this value. Min=2000 Max=20000 Def=15000 |
| 0B | Maximum mask - Mask time will be limited to this number of microseconds. Min=100 Max=32000 Def=500 |
| 0C | Minimum mask - Mask time will be at least this number of microseconds. Min=10 Max=32000 Def=50 |
| 0D | Starting mask - The mask will be this number of microseconds when closed loop mode is first entered. Min=100 Max=32000 Def=500 |
| 0E | Cross-over speed - This is the speed at which the control will switch between open and closed loop operation. Min=100 Max=2000 Def=2000 |
| 0F | Revision # (RO) - Version number of this control ROM. The high byte is for major revisions and will be zero until the first full release. The second byte is for minor corrections and additions that remain upwardly compatible within a major revision. The lower two bytes are for special versions that may not be supported in future releases. |
| 10 | Stall detect time in microseconds. Min=1000 Max=32000 Def=3000 |
| 11 | Hold time - Time in milliseconds to remain at 100% power after the end of a move. Min=0 Max=1000 Def=10 |
| 12 | Motor status (RO) - Zero indicates idle, non-zero indicates moving. This is the register returned with the move complete response as an ending |

TABLE 3-continued

| MOTION PARAMETER REGISTERS | |
|---|---|
| NUMBER | NAME |
| | status. Bit 0 (LSB) indicates a normal stop. If bit 1 is set the motor stalled. If bit 2 is set the motor stopped for a limit switch. If bit 3 is set the motor received a stop command. If bit 4 is set the motor received an emergency stop command. This register always reads zero once the motor is stopped. |
| 13 | Remaining steps (RO) - Number of steps remaining in current move. |
| 14 | Limit input port (RO) |
| 15 | Minimum delay - The minimum number of microseconds that the controller will wait after COMM is valid before switching the motor phases. Min=3 Max=32000 Def=3 |
| 16 | Current delay (RO) - The delay time in microseconds that the controller is currently using. This number is only valid while the motor is running in the closed loop mode. |
| 17 | SW-COMM (RO) - The elapsed time, in microseconds, from when the motor phases switch until the COMM signal is valid. |
| 18 | Current mask (RO) - The current length of the mask in microseconds. |
| 19 | Speed (RO) - The current speed in pulses per second as computed from the SW-COMM and delay registers. |
| 1A | Jog holding current duty cycle. (0–100%) Min=0 Max=100 Def=0 |
| 1B | Jog hold time - Time in milliseconds to remain at 100% power after each step. Min=0 Max=1000 Def=10 |
| 1C | Chop frequency - Select chop frequency to be used for holding and microsteps. Min=8000 Max=20000 Def=20000 |

(RO) means (Read Only)

TABLE 4

| ERROR MESSAGES | |
|---|---|
| NUMBER | NAME |
| 01 | Undefined command |
| 02 | Range error, value is to high |
| 03 | Range error, value is to low |
| 04 | Parameter overrun. Parameter byte received when command was expected. |
| 05 | Attempted to write to a read-only register |
| 06 | Parameter underrun. Command byte received when a parameter byte was expected. |
| 07 | Invalid motor number. |
| 08 | Register or table number too large. |
| 09 | Invalid while motor is running |
| 0A | EEPROM format does not match the revision required by the current revision of the program. |
| 0B | EEPROM data for current motor is not vlaid so the 'restore' command was not executed. |
| 0C | Checksum error on EEPROM data. The 'restore' command was not executed. |
| 0D | All control channels busy. An attempt was made to move more motors concurrently than is permitted. |
| 0E | Table entry index number is too large. |

TABLE 4-continued

| ERROR MESSAGES | |
|---|---|
| NUMBER | NAME |
| | (data=max entry index) |

TABLE 5

| TABLES | |
|---|---|
| NUMBER | NAME |
| 00 | First steps |
| 01 | Last steps |
| 02 | Ramp times |
| 03 | Ramp distances |

(RO) means (Read Only)

The user interface 304 preferably comprises a graphics LCD display 342, a touch panel overlay 344, interface electronics for coupling with the pad printing machine, LCD drivers, and power supply voltage converters (not shown). A suitable touch-display is a Part No. TVM2464 touch-display available from C Sys Labs, Inc. The user interface further comprises a microprocessor 346 and RAM 348 for controlling user interface functions, which can be coupled to the central controller using a conventional 20 pin ribbon cable. The pin assignments are provided in Table 6. The pins generally correspond to power and ground lines, an 8-bit instruction and data bus, and two address lines. Commands written to the user interface from the central controller are written to a data register coupled to the microprocessor. If an instruction requires additional data, the microcontroller 320 on the central controller writes data to an address 1, setting a flag to facilitate data strings of arbitrary length (i.e., when fonts are downloaded in data streams from the central controller to the user interface). A status register can be read at almost any time by the microcontroller 320 from an address 3. Data transmitted from the microprocessor to the central controller is read from address 0 by the central controller. The commands can include, for example, an instruction by the central controller to the user interface to write data or a command to memory. Further, the central controller can instruct the user interface microprocessor to read data from a designated address or from the status register. The instruction set between the central controller and the user interface is divided into eight groups listed in Table 7. The command types include font selection, cursor positioning and text configuration, button, text and graphics input, display control and system instructions.

TABLE 6

| USER INTERFACE PIN ASSIGNMENTS | | | |
|---|---|---|---|
| Pin # | Function | Description | Type |
| 1 | VSS | VSS Power connection | Power |
| 2 | RESET/ | Module Reset, Negative | In |
| 3 | DEN/ | Module Enable, Negative | In |
| 4 | DRD/ | Read, Negative | In |
| 5 | DWR/ | Write, Negative | In |
| 6 | DIBF | Input Buffer Full, Positive | Out |
| 7 | DOBF/ | Output Buffer, Full Negative | Out |
| 8 | ERROR | Module Error, Positive | Out |
| 9 | KEYPRESS | Key Pressed Flag, Positive | Out |
| 10 | DA0 | Address 0 | In |
| 11 | DA1 | Address 1 | In |
| 12 | D0 | Data 0 | I/O |
| 13 | D1 | Data 1 | I/O |

TABLE 6-continued

| USER INTERFACE PIN ASSIGNMENTS | | | |
|---|---|---|---|
| Pin # | Function | Description | Type |
| 14 | D2 | Data 2 | I/O |
| 15 | D3 | Data 3 | I/O |
| 16 | D4 | Data 4 | I/O |
| 17 | D5 | Data 5 | I/O |
| 18 | D6 | Data 6 | I/O |
| 19 | D7 | Data 7 | I/O |
| 20 | VCC | Power | Power |

TABLE 7

| USER INTERFACE INSTRUCTION SET | |
|---|---|
| Font Selection - | Select Font |
| | Down Load Font |
| Cursor Positioning - | SetXY |
| | ReadXY |
| | Cursor Up |
| | Cursor Down |
| | Cursor Left |
| | Cursor Right |
| | SetX |
| | SetY |
| | Set Cursor Atrib. |
| Text Configuration - | Set Text Window |
| | Set Pitch |
| | Set Height |
| Text Input - | Input String |
| Graphics Input - | Draw Box |
| | Draw Block |
| | Draw Horiz |
| | Draw Vert |
| | Draw Vector |
| | Set Pixel |
| Button Input - | Place Button |
| | Load Button Buffer |
| | Get Button Size |
| | Place Phantom Butt. |
| | Delete Button |
| | Delete All Buttons |
| | Read KeyCode |
| | Set Button Attrib. |
| Display Control - | Blank Display |
| | Clear Display |
| | Refresh |
| | Set Auto Refresh |
| | Dump Display RAM |
| | Load Display RAM |
| | Move Block Vert |
| | Move Block Horiz |
| System Instructions - | Soft Reset |
| | Set Contrast |
| | Set EL |
| | NOP |
| | Set Beeper |
| | Read Key Matrix |

To better illustrate the control process, the operation is discussed below in terms of a state diagram and flow chart in FIGS. 18, 19A–19H and 20. With reference to the state diagram shown in FIG. 18, the central controller 300, the user interface 304 and the motor controller 302 are powered "on" in State 1. In State 2, the central controller 300 initializes its microcontroller using a conventional "boot" routine. Using dedicated I/O lines, the central controller 300 releases both the user interface 304 and the motor controller 302 from a reset state and transfers data to both devices in order to begin initialization of their respective microcontrollers. In general, the central controller 300 sends initial, default values for the motion parameters to the motor controller for each of its motors. The central controller also sends data for display screens and font sizes to the user interface. The initialization state is discussed in further detail below with respect to FIG. 19A–19H.

In State 3, the central controller 300 commands the motor controller 302 to move the pad and plate to their home positions along their respective axes. The central controller 300 receives pad home and plate home signals which are generated by the motor controller upon receipt of input signals from the corresponding home sensors 84, 140. As described in further detail below, the initial starting positions of the pad and plate along their respective axes can be changed by user-generated input values specifying a different resting position.

If no errors are detected during the initialization and homing stages, the central controller 300, the user interface 304, and the motor controller 302 enter a ready state as indicated by State 4. The system is now ready to receive process information and a TRIGGER signal to begin the printing operation. The motor controller 302 operates in accordance with empirically determined motion parameters values stored in the RAM of the central controller during a set-up operation, as shown in State 6. In State 7, a user can input various process parameters to the central controller using the touch panel on the user interface. Screens are provided on the user interface LCD display by the central controller to guide the operator.

The set-up screens generally allow the operator to specify process parameters related to pad stroke parameters (pad resting position, pad-to-plate stroke length and pad-to-product stroke length in millimeters), pad-to-plate speeds for both up and down motions in centimeters per second, pad-to-product speeds for both up and down motions, as well as pad dwell times. Pad dwells include the time the pad remains in contact with the product (pad/product dwell time), the time the pad remains in the operator-defined resting position before transferring the legend from the pad to the product (pick-up delay time), and the time the pad remains in contact with the plate (pad/plate dwell time). The user can use the user interface to enter the plate resting position in millimeters, the plate stroke (i.e., the distance the plate will travel in millimeters), the plate speeds in centimeters per second when extending outward to contact the pad and subsequently retracting, and the plate dwell times. The velocities and distances are expressed above in the metric system, but may also be expressed in the English measurement system. The plate dwell times include the amount of time that the plate remains in the extended or retracted position. The user can also enter the overall cycle rate, the delay time between the cycle trigger and the beginning of the cycle (trigger delay time) and the cycle delay time, that is, the delay time between the end of a cycle and the beginning of the next cycle. The process parameters are listed below as TABLE 8. If the user provides a process parameter value that is not within a predetermined range, the user is provided with an error message on the display screen in State 8.

TABLE 8

| PROCESS PARAMETERS | |
|---|---|
| 1. | Trigger delay - the amount of time between reception of a trigger signal and the start of the print cycle. |
| 2. | Plate extension stroke length. |
| 3. | Plate extension step rate. |
| 4. | Plate extension dwell - the amount of time the inked engraved image is exposed to air before the pad is brought into contact with the inked image and lifts the ink film. |
| 5. | Pad-to-plate extension stroke length. |
| 6. | Pad-to-plate extension speed. |

TABLE 8-continued

| PROCESS PARAMETERS | |
|---|---|
| 7. | Pad-to-plate extension dwell - the amount of time the pad contacts the printing plate. |
| 8. | Pad-from-plate return stroke length. |
| 9. | Pad-from-plate return speed. |
| 10. | Plate return stroke length. |
| 11. | Plate return speed. |
| 12. | Plate return dwell the amount of time the engraved image is held under the reservoir before its next extension. |
| 13. | Pad-to-product extension stroke length. |
| 14. | Pad-to-product extension speed. |
| 15. | Pad-to-product extension dwell - the amount of time the pad contacts the product to be marked. |
| 16. | Pad-from-product return stroke length. |
| 17. | Pad-from-product return speed. |
| 18. | Cycle delay - the period after the basic cycle is complete and before a new cycle may be initiated. |
| 19. | Overall cycle time. |

After the motion parameters are stored in the central and motor controllers (State 6) and the user has entered the process parameters (State 7), the central controller progresses from the READY state (State 4) to an OPERATE PRINTER state (State 5) upon sensing that a TRIGGER signal has been received either from the user interface 304 or from an external system.

With reference to State 9, the central controller initializes cycle timing analysis using a set of process strokes, velocities, dwells and delays to obtain an estimate of overall cycle time. The set variables can be entered by the user, or obtained from the RAM 332 (FIG. 17) if they were previously saved as default values. If the estimated cycle time is longer than the cycle time requested by the user, an error message is provided on the display 342 of the user interface (States 10 and 11). The user can make adjustments to the process parameters by using the touch panel 344 of the user interface 304 to send data to the central controller (States 6, 7 and 8). In addition to timing (State 9), error messages pertaining to trigger input signals (State 5), for example, as well as events in States 12 through 15 are provided by the error handler in States 10 and 11.

If no error messages pertaining to the motion and process parameters or cycle time are displayed, the basic print cycle commences (State 12). Each move-time in the print cycle is measured using a timing register. The estimated move-times obtained in State 9 for each of the moves is compared with the move-times measured during State 12 (State 13). In State 13, cycle performance is analyzed at the end of each move during the print cycle to determine if an adjustment should be made to a process parameter. This analysis state is discussed in more detail below with reference to FIG. 19A–19H.

In State 14, dynamic tuning is used to ensure that the pad printing machine is operating at optimum speeds or close to the user-specified speed and cycle rate. Dynamic tuning is also used to compensate for excessive loading of the motors. If the cycle rate determined by the central controller is different (i.e., greater or lesser) than the user-specified cycle rate, the central controller is programmable to modify selected ones of the process parameters to compensate for the overall cycle rate difference.

If measured move times are significantly greater than estimated times, the probable cause is generally excessive loading of the pad or plate axis possibly due, for example, to the use of a large pad or a heavy doctoring pressure. The motor controller 302 employs an L/R stepping motor drive system in which excess pull-out torque is generated in the motors 26 and 28 at low step rates and motor stalls are more probable. For this reason, the motor controller 302 is provided with a number of tuning sets corresponding to different ranges of step rates. Preferably, there are at least two sets corresponding to high and low speed ranges. However, more tuning sets would generally be desired. The tuning sets comprise values of motion parameters that affect detent torque and stiffness of motion for a given axis, that is, holding-current duty cycle, jog-hold duty cycle, jog-hold time, and holding frequency as well as first-step and last-step times. The values of the parameters are empirically determined to compensate excessive loading by increasing, for example, applied motor voltage or holding current or first and last step timing table values. The tuning sets can be stored in motor controller memory, stored in central controller memory and downloaded as with other commands and data, or provided to the central processor for downloading to the motor controller by an external system using, for example, an RS232 serial port on the connector board 322 (FIG. 16).

As stated previously, the motion parameters can be stored in the digital memory of the central controller 300 for use at a later time. The updated parameters are provided to this digital memory (RAM 332), as well as to the user interface and the motor controller in State 15.

FIG. 19A–19H comprise a flow chart of the print cycle operation. As indicated in block 360, the pad printing machine is initially powered on. Power can be supplied to the pad printing machine either manually through the use of a control enclosure power switch or remotely using a power distribution system associated with an automated parts-handling system that can be employed in conjunction with the pad printing machine. Similarly, the user interface 304 and the motor controller 302 are powered on either manually or through the power distribution system of an automated-parts handling system coupled to the pad printing machine. With reference to block 362, the microcontrollers 320 and 346 associated with the central controller and the user interface, respectively, and the microcontroller on the motor logic board 336 are initialized in a conventional manner. For example, the microcontroller 320 executes program code stored in the ROM 330 which executes a conventional "boot" routine to set memory registers (i.e., stack pointers) and create a memory environment in external memory and on-chip memory for use by print cycle control code stored in the ROM 330. The microcontroller 320 also intializes on-chip memory and input/output (I/O) control registers, and the microcontroller interrupt control structure. Further, the system clock (not shown) associated with the microcontroller is started, serial communications channels and on-chip timers are initialized, and external I/O lines are set to specified states for operation (i.e., a number of I/O lines are disabled for initialization purposes).

With continued reference to block 362 of FIG. 19, the microcontroller 320 employs a dedicated I/O line to send a reset command to the user interface controller 346 and to initiate the transfer of set-up data (i.e., user screen modes and font sizes for the display). The user interface controller 346 stores the data and uses the data for subsequent data transfers (i.e., user-specified motion parameters and replies to central controller commands) to the microcontroller 320. Using another dedicated I/O line, the microcontroller 320 transmits a reset command to the motor controller microprocessor and initiates the transfer to the motor controller of set-up data comprising two sets of motion parameters for controlling the movement of the pad and plate along their respective axes. The central controller preferably reads the motion parameters from the RAM 332; however, the user can enter motion parameters via the user interface. In particular, the set-up data comprises initial values for the following motion parameters (Table 3) for each motor channel: base and run speeds, holding current and jog-hold duty cycles, unit time, slope, maximum top and crossover speeds, maximum, minimum and starting mask times, stall-detect, hold and jog-hold times, and holding frequency. The motion parameter values are empirically determined by the pad printing manufacturer through field testing of the pad printing machine 10 and stored in the RAM 332.

As shown in block 364 of FIG. 19, the central controller 300 transmits a command to the motor controller to recalculate the ramp tables using the set-up motion parameters. After the motion parameters and tables have been either specified or calculated, the motor controller stores a set of the parameter and table values in digital memory on the motor logic card 336, as shown in block 366. The central controller reads the ramp tables from the motor controller to estimate process move-times for use later in dynamic tuning of cycle timing. The ramp distances and times tables are generally not recalculated again unless at least one of the following motion parameters change: crossover and maximum speeds, the unit time, and the slope. The resting positions are subsequently transmitted to the motor controller along with a command to move the pad and plate (Table 1) to these positions, as shown in block 372. Additionally, the central controller stores several tuning sets described below in connection with FIG. 20 in its RAM 332 for use in the dynamic tuning process of compensating for excessive loads.

The central controller sends a command to the motor controller to move the pad and plate to their home positions, which are designated by pad and plate home sensors 84 and 140 (FIG. 16) in the pad printing machine, as indicated in block 368. At this point, the central controller is in a READY state (State 4 of FIG. 18) if the central controller detects no errors relating to the operation of the central, motor and user interface controllers during initialization and set-up.

As shown in block 370, the user can enter process parameters, for example, any of the nineteen parameters listed above in TABLE 8, using the user interface 304, or an external controller via an RS232 serial port on the connector board 322. The user can also operate the user interface to transmit data signals to the central controller that request the application of previously stored sets of process parameters to the current print cycle. Further, the resting positions of the pad and plate, which are based on the user's knowledge of the physical properties of the pad, ink and product, are usually entered using the user interface 304 and stored in the RAM 332. As will be described in further detail below, in connection with block 382, the user specified speed parameters are used to determine the run speeds per stroke.

As an example of user entry of process parameters, a user generally examines the pad printing machine to determine the distance between the pad intended for use and the printing plate's surface, that is, the pad-to-plate stroke length and the pad resting position, based on the size and compression characteristics of the pad. Similarly, the user inspects the pad printing machine to determine the pad-to-product stroke lengths and the plate resting position. These quantities do not change frequently at a particular user site and can be stored in RAM 332 along with other process parameters sets corresponding to other ink, product, and pad type combinations. Further, the stored sets can be modified in part, i.e., only a few parameters at a time, or completely.

The user-specified values for plate extension speed, pad-to-plate extension speed, pad-from-plate return speed, plate return speed, pad-to-product extension speed and pad-to-product return speed and their corresponding stroke lengths are converted from their respective units of centimeters per second (cm/s) and centimeters (cm) to steps per second and steps. The motors, lead screws, and holders are preferably configured so that 91.86 steps of the stepping motor are equivalent to one centimeter of movement of the pad or plate. In this way, the user specified speeds (cm/s) and stroke lengths (cm) can be multiplied by a factor of 91.86 steps per centimeter to obtain the corresponding step rates and number of steps desired.

Figure 18:
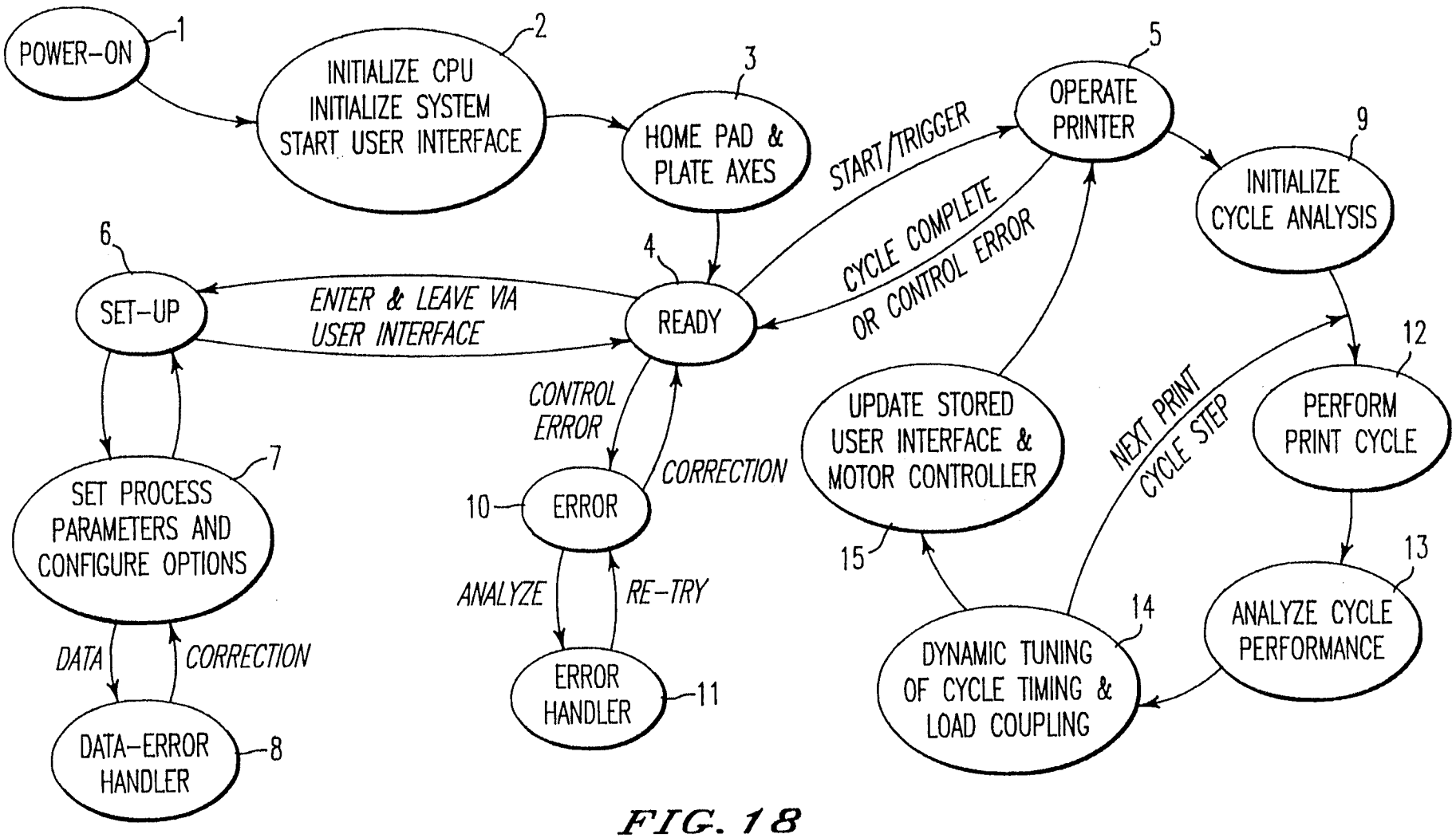
FIG. 18 is a state diagram of the overall control process of the present invention.
Figure 19A:
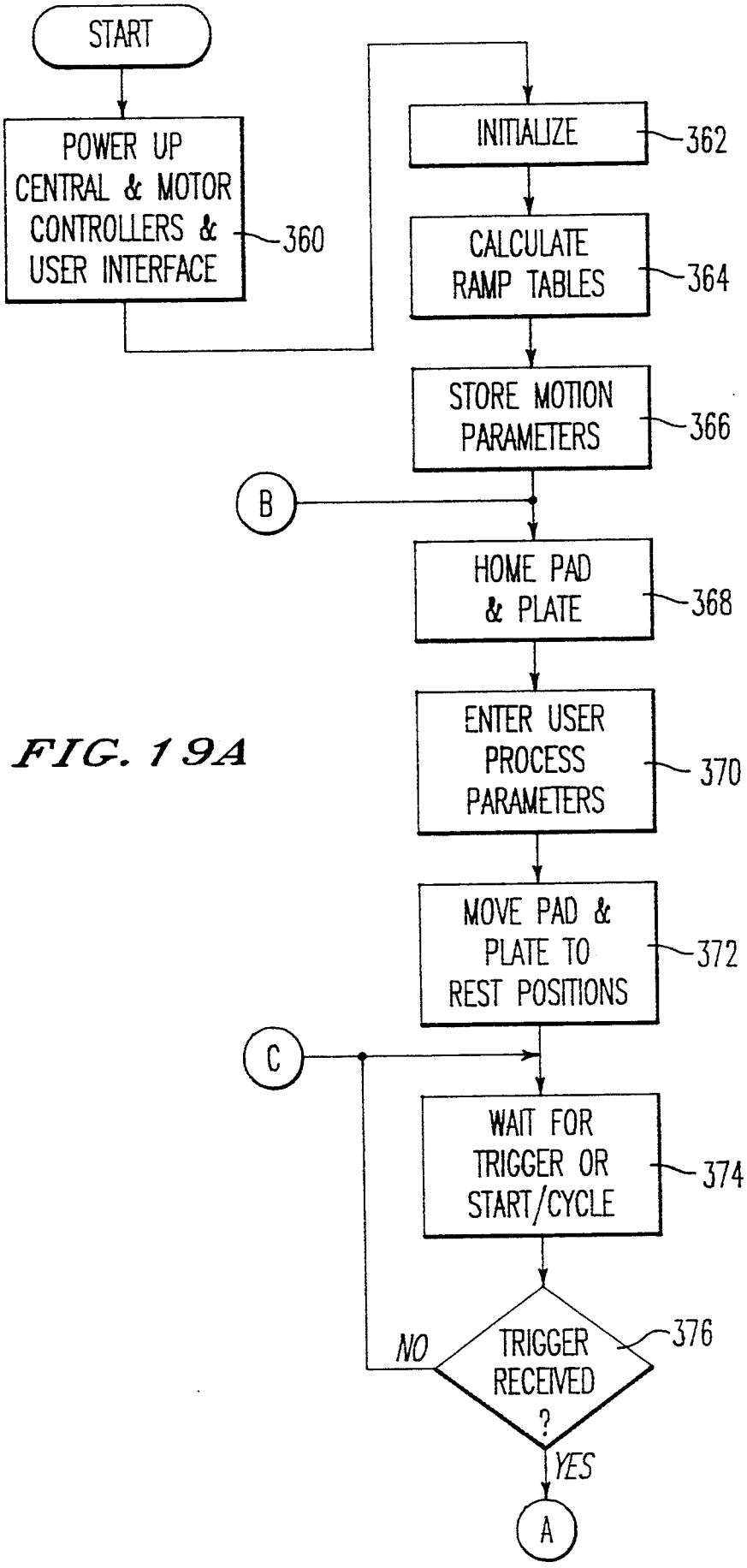
FIGS. 19A–19H comprise a flow chart illustrating the control process.
Figure 19B:
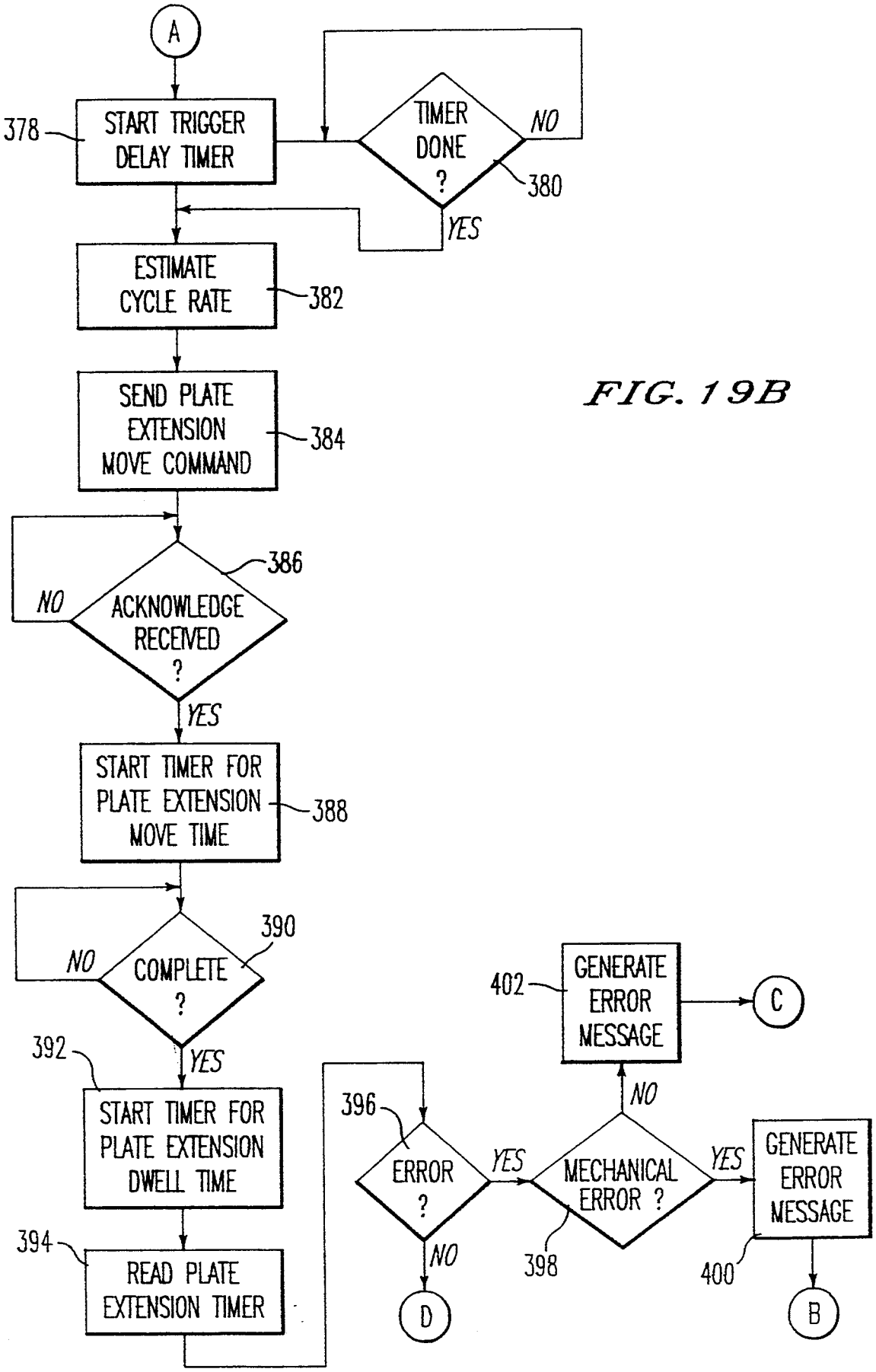
Figure 19C:
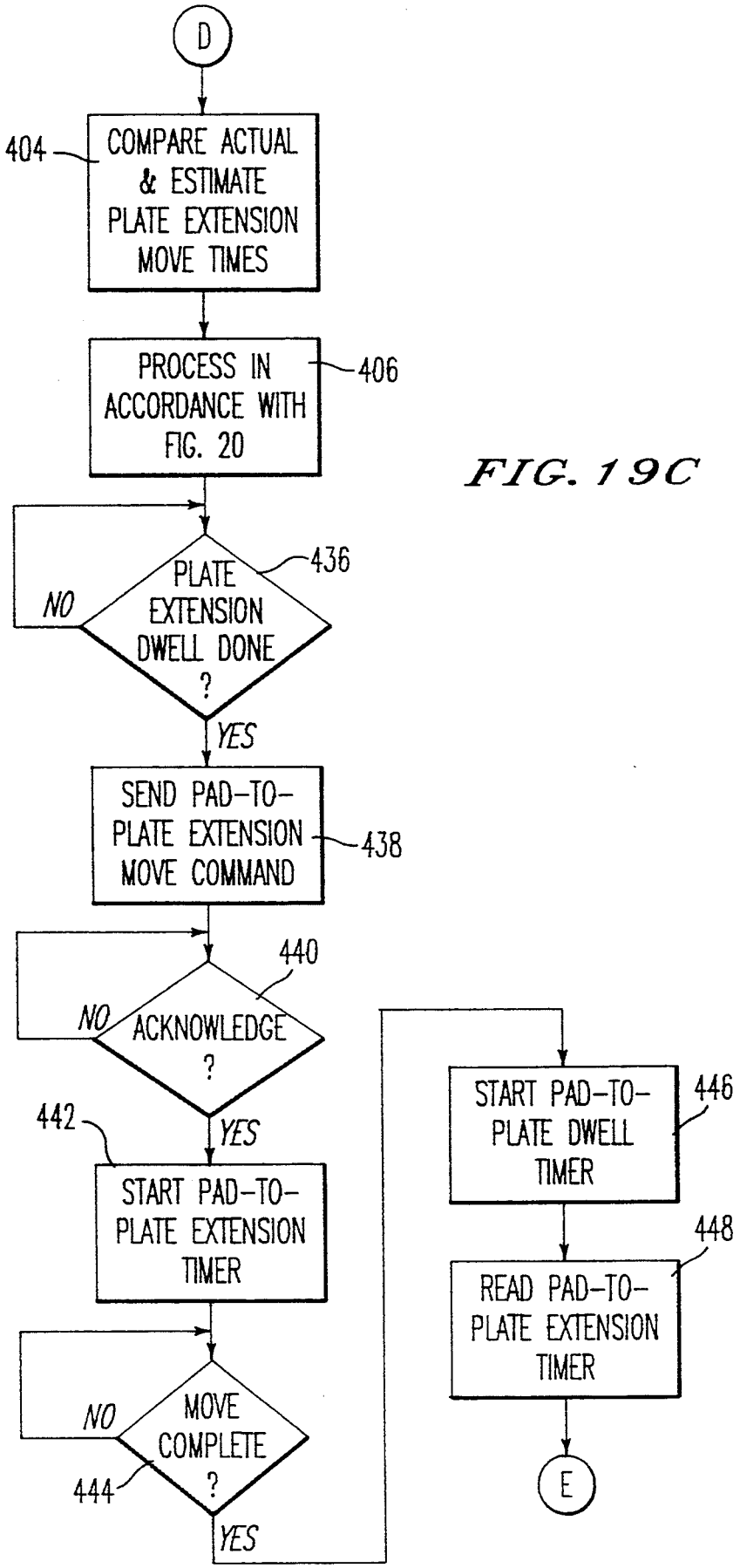
Figure 19D:
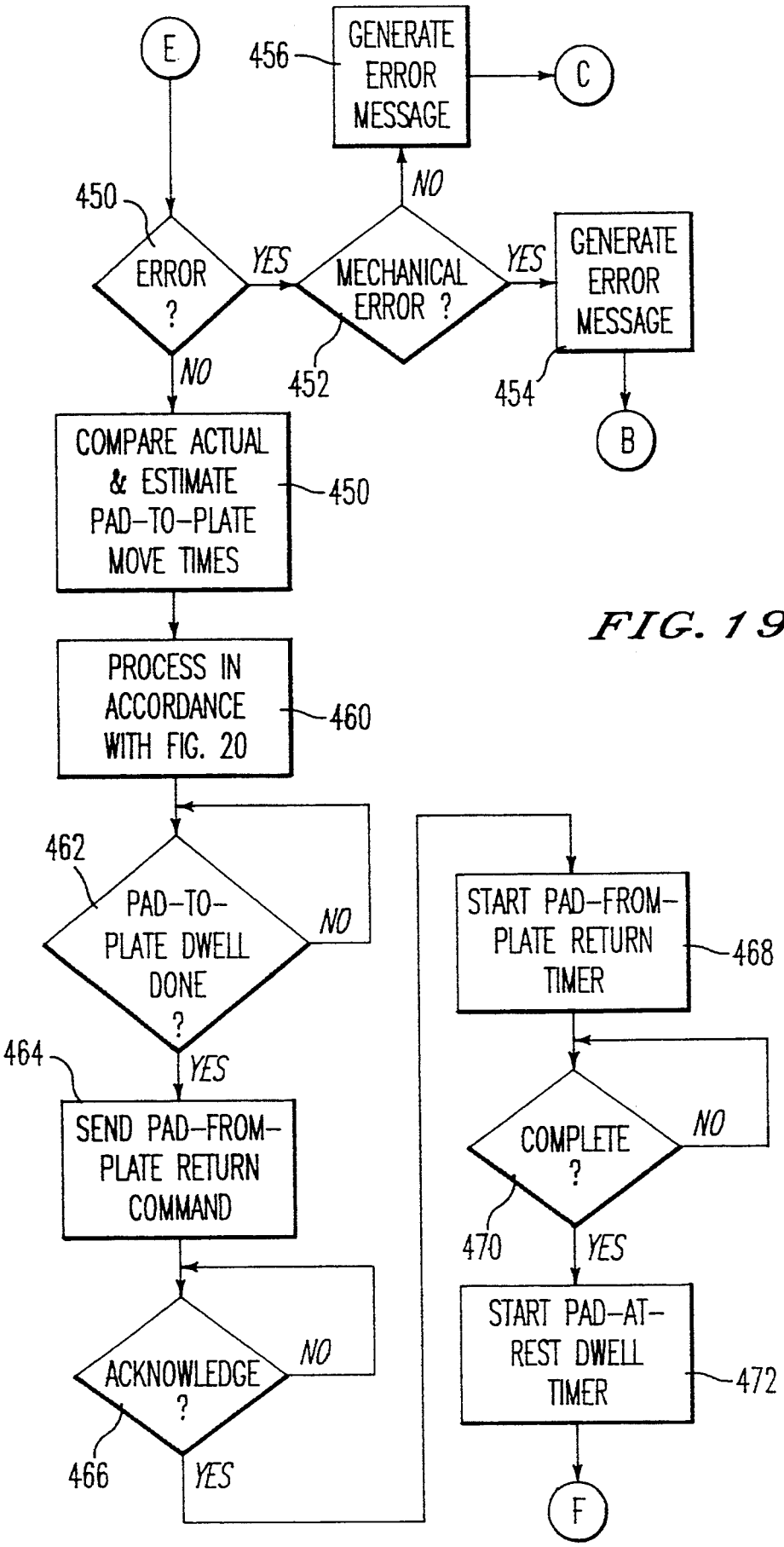
Figure 19E:
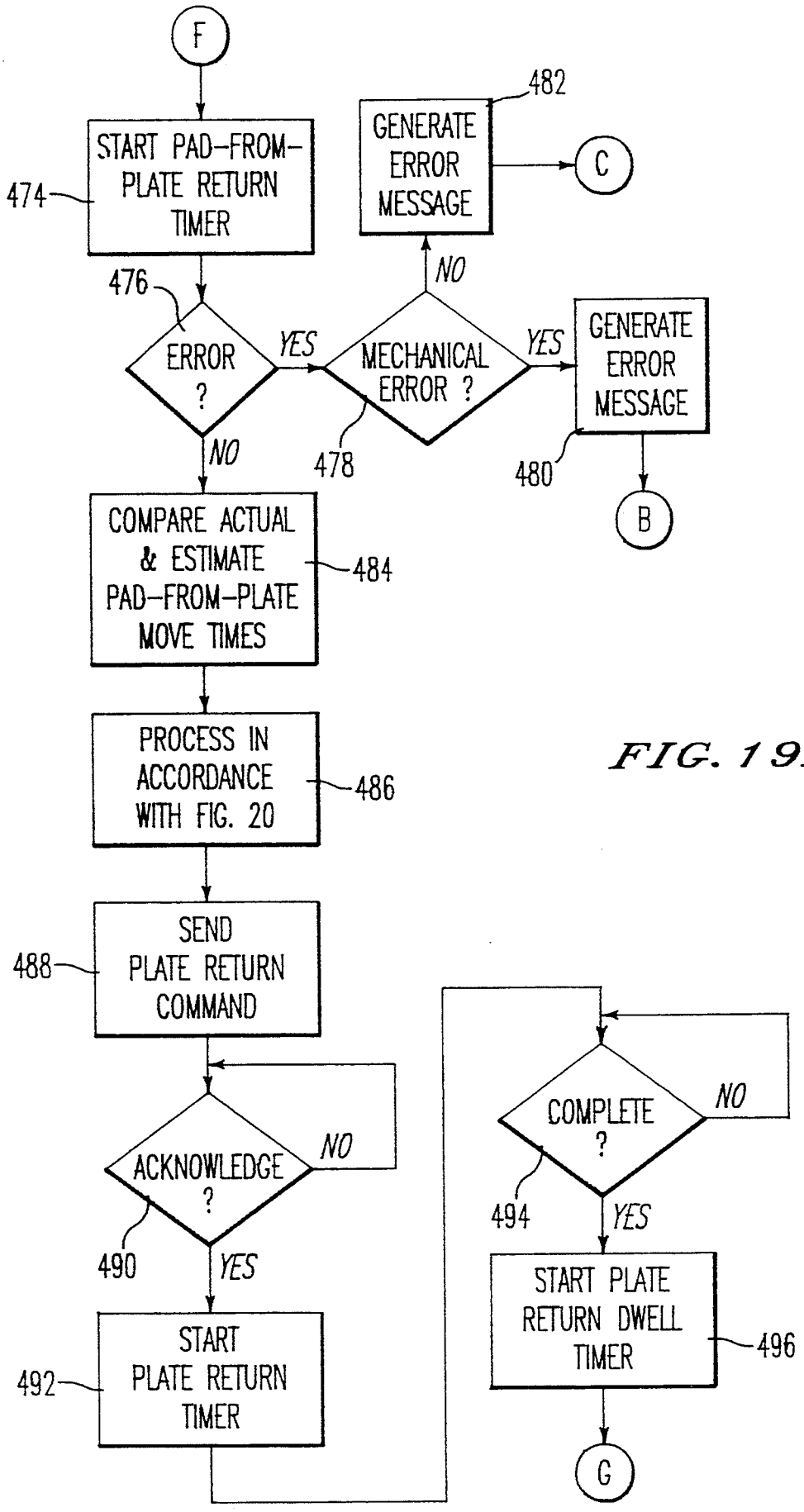
Figure 19F:
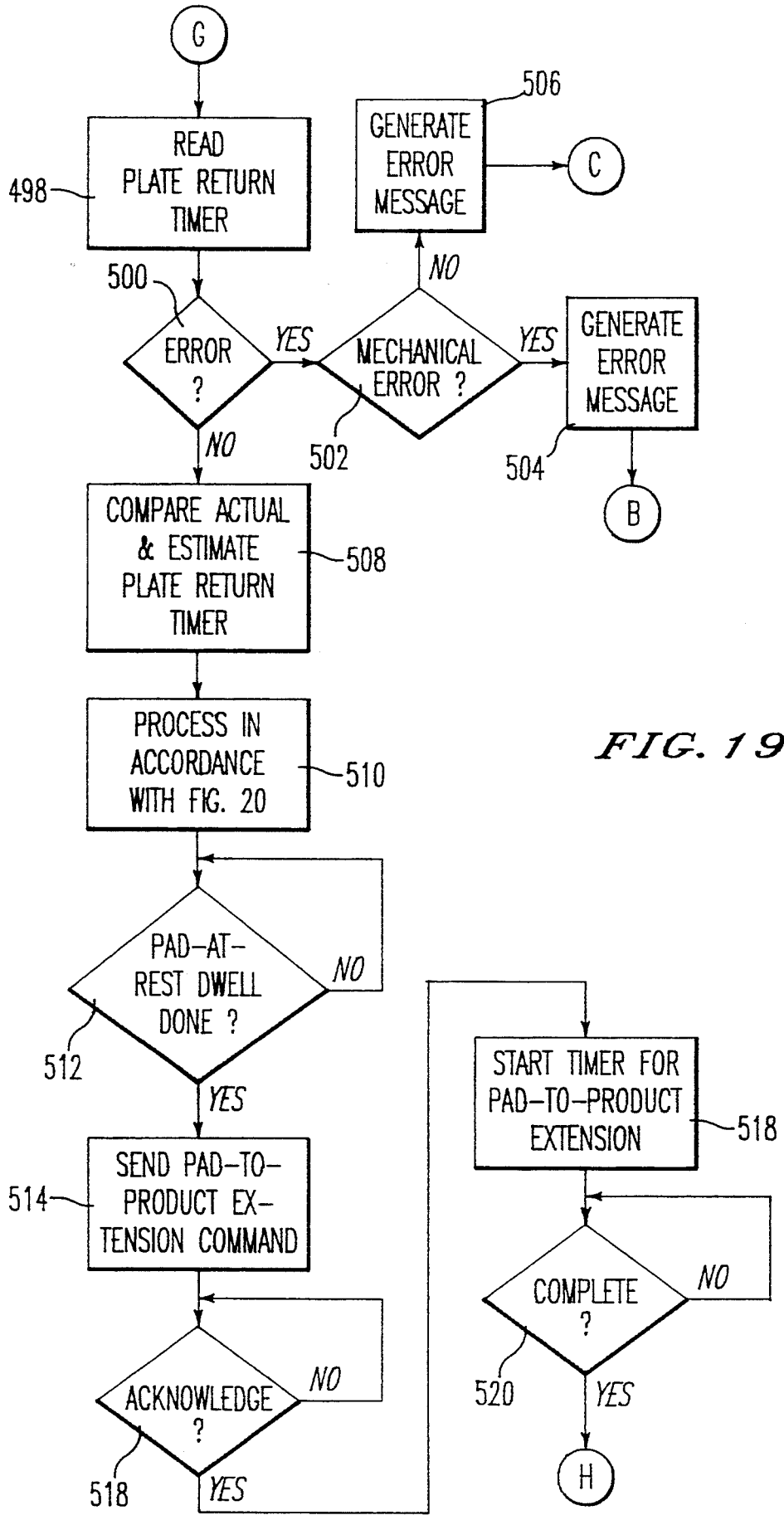
Figure 19G:
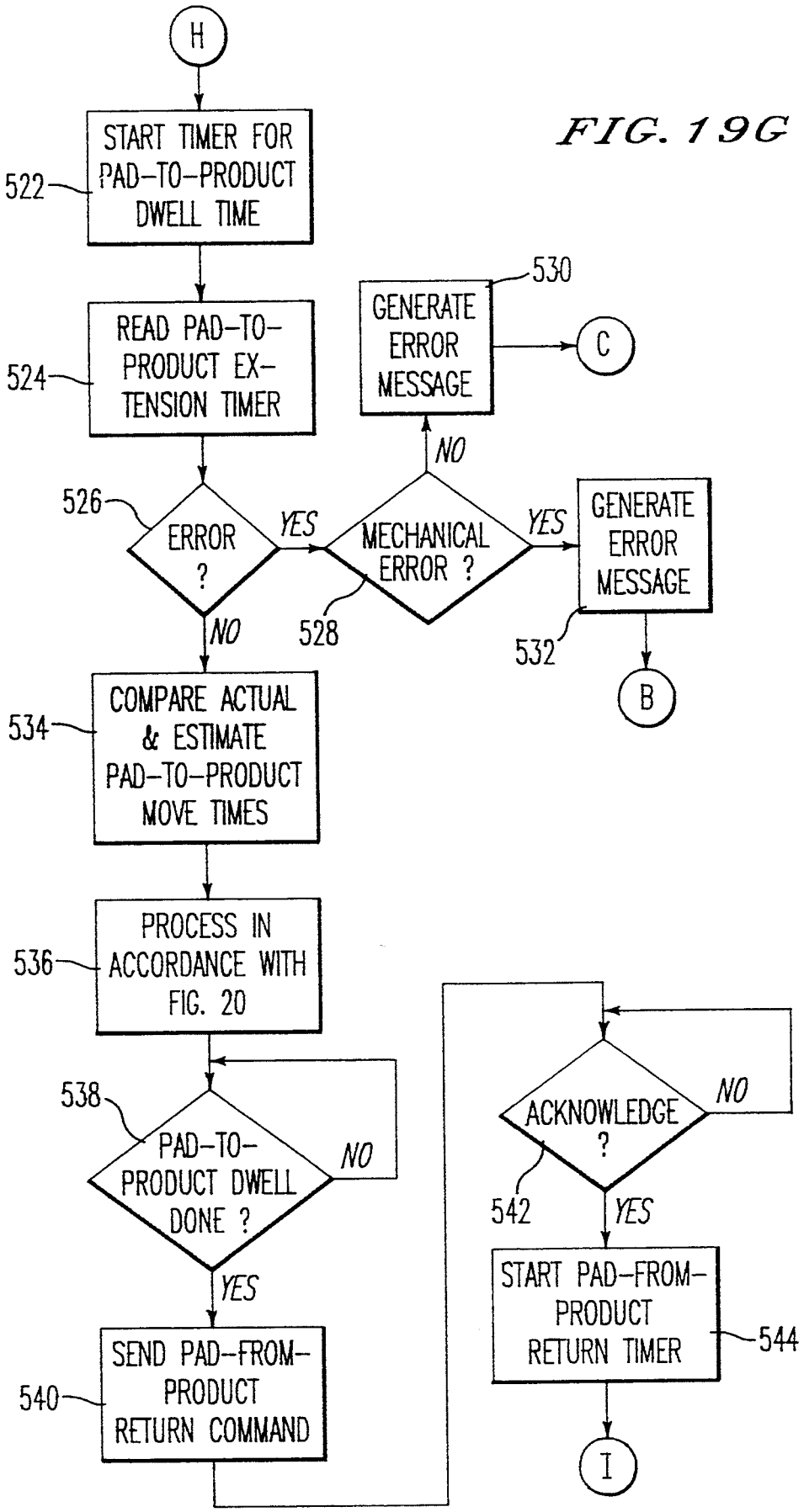
Figure 19H:
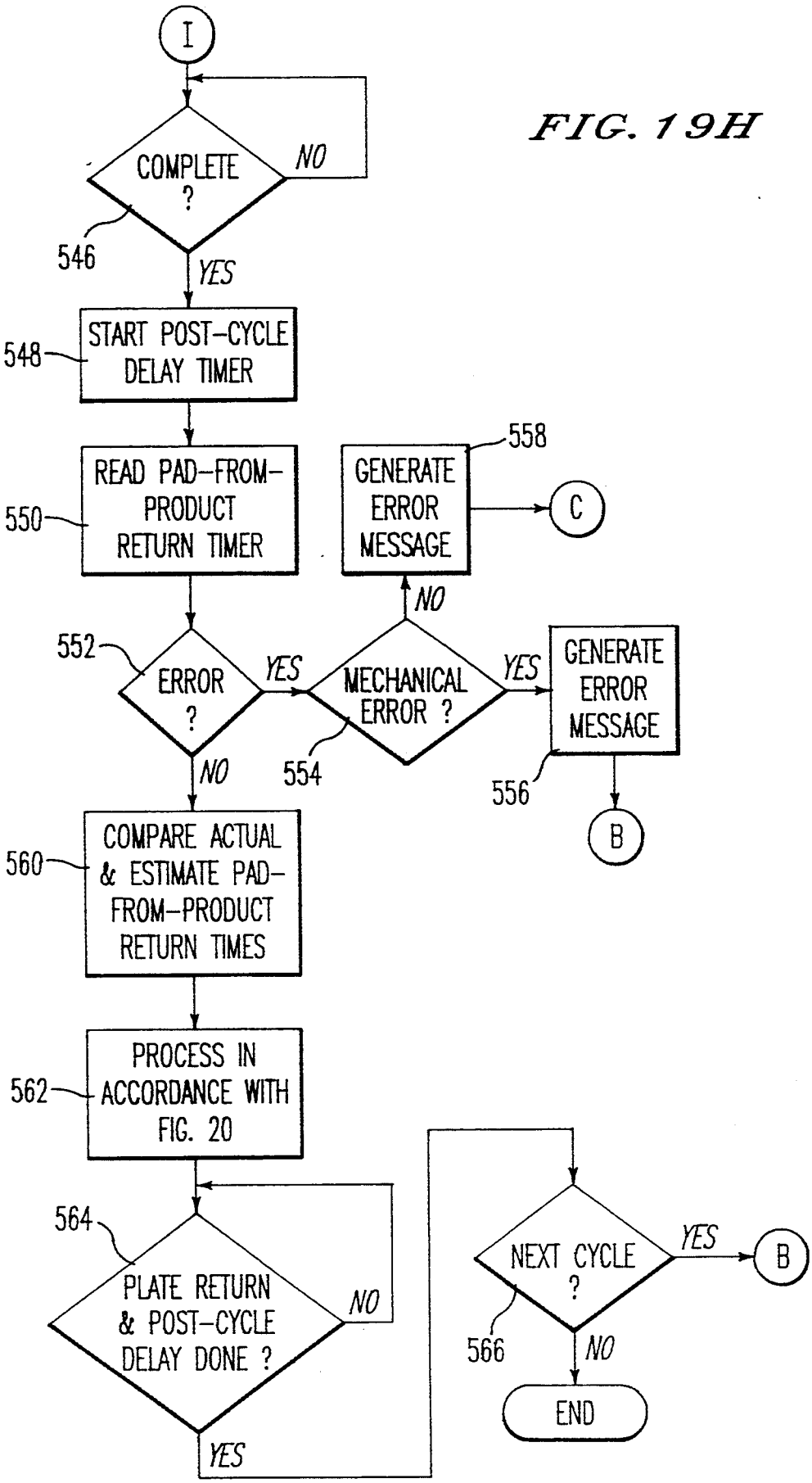

With continued reference to block 370 of FIG. 19, the user can indicate to the central controller via the user interface those process parameters that are critical (e.g., pad-to-plate dwell) and therefore are not modifiable during the adaptive tuning of State 14 of FIG. 18. While several process parameter sets can be stored in RAM 332, typically only one process parameter set is retrieved from memory by the central controller and used during a print cycle. The user can manually alter a process parameter at any point during the print cycle using the user interface 304. The process parameters are stored and can be used in a subsequent print cycle. Alternatively, the set-up process for the process parameters, as well as the motion parameters, can be executed by an external controller, along with status requests and START-CYCLE commands over, for example, an RS232 serial link.

After the motion and process parameters and ramp tables are stored in the digital memories of the central and motor controllers 300 and 302, the central controller waits to receive a TRIGGER input signal or a START-CYCLE command from either the user interface 304 or from an external controller, as indicated in block 374 and the negative branch of decision block 376. After the TRIGGER signal is received, the central controller 300 starts a timer to delay further print cycle operations until the trigger delay time, if any, has expired, as shown in blocks 378 and 380. The central processor thereafter begins cycle timing analysis (State 9 of FIG. 18) by processing the motion and process parameters stored in RAM 332. With reference to block 382, initially the overall, estimated cycle rate is determined. The overall, estimated cycle rate is the reciprocal of the overall cycle time, i.e., the sum of the following quantities: the plate extension move-time, the pad-to-plate extension move-time, the pad-from-plate move-time, the plate return move-time, the pad-to-product extension move-time, the pad-from-product return move-time, any non-zero dwell times (i.e., plate extension dwell, pad-to-plate extension dwell, plate return dwell, and pad-to-product extension dwell) and any non-zero delay times (i.e., trigger delay, and cycle delay). The move-times are calculated in terms of steps per second based on the user-input stroke lengths and stroke speeds (both values which will have been converted by the central controller into steps and steps per second, respectively) and the ramp distance and ramp time tables.

To calculate a move time, the central controller first refers to the ramp times table and based on the corresponding user-input stroke speed or velocity, retrieves a unit-time from the table. The unit-time functions as an index. Taking the unit-time, the controller refers to the ramp distance table and retrieves the number of steps required to reach the user-input stroke velocity. The controller then determines from the ramp times table the corresponding step duration for the number of steps—in other words, determines the time it takes to reach the user-input velocity. Since the calculation up to this point only determines the time it takes to ramp up and reach the user-input velocity, the time duration is multiplied by two to cover the duration for both the ramp up to the velocity and the ramp down when the motor is decelerated from the user-input velocity level to zero. In order to determine the time between the ramp up and ramp down portions of the cycle, i.e., to determine the run or slewing time, the number of steps to be taken during the run or slewing time must be calculated. To do so, the number of steps required to reach the user-input velocity as determined from the ramp distance table above is multiplied by two to get the number of steps taken during both the ramp up and ramp down. This value is subtracted from the converted step value of the overall stroke length that is input from the user to get the number of steps for the run time. This value is divided by the converted user-input velocity to determine the duration of the run time. This duration of run time is then added to the ramp up/ramp down duration time calculated above in order to get the total time for the move. Each of the moves is calculated in the same manner and added to the non-zero dwell and delay times to obtain the overall estimated cycle time. The cycle rate is then determined by taking the reciprocal of the overall cycle time.

Once an estimate of the cycle rate is made (block 382 of FIG. 19), the central controller transmits a move command to the motor controller to move the plate motor at a designated speed and to a designated point along the plate axis, as indicated by block 384. The step rate and destination coordinates are sent in the bytes following the command byte. As indicated by the affirmative branch of block 386 and in block 388, the central controller starts a timer register to determine the actual plate-extension move-time after the motor controller returns an acknowledgment signal. After the motor controller executes the command and sends a "Move Complete" status signal to the central controller, the central controller begins a timer, as shown in block 392, to measure plate extension dwell time. The central controller also stops the timer register for plate extension move-time and obtains from its contents the actual plate-extension move-time, as shown in block 394.

If the actual move-time is significantly different from the estimated move-time, the motor will most likely stall. With reference to decision blocks 396 and 398 and block 400, an error signal is sent to the user interface to notify the user that a mechanical problem with, for example, a motor, the handler, or other part of the pad printing machine has been detected. The central controller subsequently returns the pad and plate to their home positions (block 368). If the error is not the result of a mechanical problem, the user is notified via the user interface, as indicated in block 402 that an error has occurred. In another aspect of the pad printing machine operation, the user interface can indicate that another type of error has occurred, i.e., trigger timing is incorrect or the heater is operating at an undesirable temperature, among other things, as shown in block 402.

The central controller compares the estimated and measured move-times to determine their difference in value, as shown in block 404. The central controller uses the result obtained in block 392 to perform dynamic tuning to compensate for excessive load coupling and undersirable variances in cycle timing (State 14 of FIG. 18), as indicated in block 406. Cycle timing is important for a number of reasons. For example, the overall cycle rate can be critical to the proper functioning of the pad printing machine in a particular application. If the printing machine is used in conjunction with and operated as a slave to a handler for the product to be printed, it is important to ensure that the printing machine speed is not slower than the product handling speed. Further, the overall cycle rate is important if the pad printing machine controls a handler, that is, the handler is a slave to the printing machine. In both of these instances, cycle rate warnings need to be provided by the central controller 300 to the user via the user interface display 342 when the central controller determines that an undesirable cycle rate is achieved.

Figure 20:
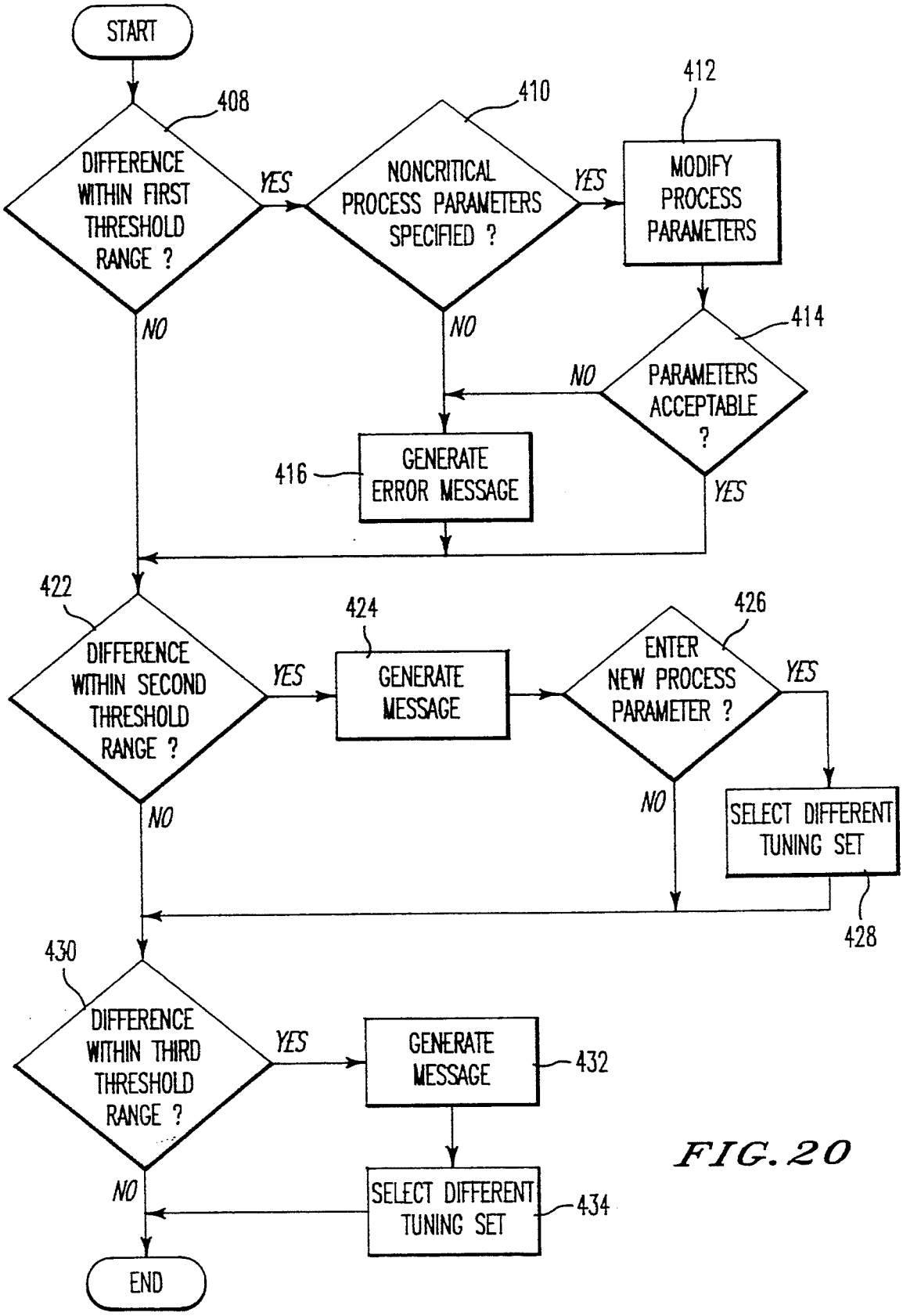
FIG. 20 is a flow chart illustrating the dynamic tuning control process of the present invention.

As indicated by block 408 of FIG. 20, the central controller determines whether the difference between actual measured time for the plate extension stroke length and the estimated move-time is within a first range of threshold values. If not, dynamic tuning of the timing cycle may be advantageous at this point in the print cycle. The central controller performs dynamic tuning of both cycle timing and load coupling in accordance with the results of its evaluation of pad printing machine performance using move-time comparisons. The central controller determines what tuning measures are to be taken by using, for example, three stored threshold values that are preferably determined empirically using field tests of the pad printing machine. It is understood that the central controller is programmable to operate using any number of threshold values as diagnostic variables during dynamic tuning. By way of example, if the actual measured move-time is within a first threshold range of values from one to two times less than the estimated time to one to two times more than the estimated time, the central controller will compensate for the difference in actual and estimated times and for the effect the difference has on future strokes and overall cycle timing by modifying non-critical process parameters.

As indicated in decision block 410, the central controller reads selected process parameters stored in RAM 332 to determine which parameters are specified by the user and/or a pad printing machine technician as being critical to the successful completion of a print cycle. If the actual stroke length requires less move-time than the estimated stroke length, then the central controller will, as indicated in block 412, change certain non-critical, zero-valued dwell and delay times to non-zero values in order to distribute the difference in estimated and actual move-times throughout the print cycle. With further reference to block 412, if the actual move-time for plate extension is greater than the estimated move-time, the central controller 300 can reduce selected, non-critical dwell and delay times by a small amount to compensate for the difference in overall cycle time.

The dwell and delay times are generally considered non-critical parameters unless the user designates one of these times as critical. Velocities and stroke lengths are considered critical to the print cycle and therefore are modified by the central controller if necessary only after dwell and delay times. The dwell and delay times can be changed to a value within a range of permissible values that are stored in the RAM 332. These values are obtained empirically and are based on user expectations of the pad printing machine performance. If, for example, the difference obtained in block 404 is a relatively small value such as 5–10 milliseconds, the central controller increases or decreases the cycle or trigger delay. If, on the other hand, the difference is larger (i.e., 50 to 100 milliseconds), the central control is programmed to distribute additional time to or reduce several of the non-critical dwell or delay times to compensate for the difference between the actual and estimated move-time. If the difference is too large, the increase or decrease in dwell and delay times required for cycle timing compensation can cause pauses or abrupt motions of machine parts that may be undesirable to the user. Thus, if a dwell or delay parameter change requires a change beyond these stored values, or there are no non-critical dwell or delay times, then the central controller provides the user with a message on the user interface display 342 indicating that the user requested cycles rate (i.e., the estimated rate based on user-specified process parameters) cannot be achieved, as indicated by the negative branches of decision blocks 410 and 414, and block 416.

The dynamic tuning of the timing cycle after the first stroke, that is, the plate extension, provides the user with an indication of cycle rate at an early point during the print cycle. Thus, adjustments in, for example, process parameters will ensure that future move-times and therefore the overall cycle rate more closely agree with user expectations. In addition to an early adjustment of cycle timing, the central controller is also programmed to dynamically tune the pad printing machine to compensate for excessive loading after the first stroke.

As indicated by the affirmative branch in decision block 422 of FIG. 20, the central controller begins dynamically tuning the load coupling of the motors if the estimated and actual move-time difference determined in block 404 is within a second threshold range of values. The second threshold range of values are preferably empirically determined from field tests of the pad printing machine of the present invention to indicate that excessive loading may have occurred in the plate or pad axis depending on which stroke has been executed. For example, if the actual time is three to four times more or less than the estimated time (e.g., 300 to 400 milliseconds), compensating cycle timing by modifying noncritical delay and dwell times may be difficult without adversely affecting the performance of the pad printing machine. In this case, the user is notified by an error message on the user interface, as shown in block 424, that excessive loading is suspected and that the user should ensure, for example, that the doctoring pressure is not excessive and that the proper ink is being used.

With reference to decision block 426 and block 428, excessive loading can be compensated for by changing tuning sets and/or modifying the voltage directly applied to the motors. A tuning set is a set of motion parameters stored in the RAM 332 which are based on the process parameters provided by the user. The tuning set motion parameters include holding-current duty cycle, jog-hold duty cycle, hold time, jog-hold time, holding frequency, the first step table and the last step table. Several tuning sets are stored in the RAM 332. Each tuning set generally corresponds to a range of pad printing machine operating speeds. One particular tuning set used during print cycle is chosen by the central controller in order to attempt to achieve the process speeds desired by the user. The user preferably does not directly choose which tuning set is used. By way of an example, three tuning sets can be stored which correspond, respectively, to slow, moderate and fast operation of the pad printing machine. The appropriateness of a tuning set selected by the central controller is determined after each step and at the end of the print cycle. If the user has requested a fast cycle rate, excessive loading has been sensed, and a moderate operation tuning set is being used, the central controller sends a message to the user requesting a change in process parameters, as indicated in decision block 426. If the user responds with different process parameters, the central controller determines whether or not to select a different tuning set based on the user response, as indicated in block 428. The new tuning set is selected to more closely match the loads so that the pad printing machine can better attempt to achieve the user requested cycle rate. If the user does not respond with different process parameters, the print cycle nonetheless continues unless the excessive loading risks equipment failure, as indicated by the negative and affirmative branches of decision blocks 426 and 430, respectively.

With continued reference to decision block 430 of FIG. 20, a third threshold range of values is preferably empirically established to delineate the point at which an attempt by the central controller to achieve the user requested operating speed risks damage to the pad printing machine. For example, the third threshold range can be defined as an estimated time value that is ten times the actual time value or greater. If the difference between the actual and estimated time is within the third threshold range, the central controller notifies the user of the loading condition and automatically selects another tuning set without first requesting the user to change the process parameters (i.e., run speed), as shown in blocks 432 and 434, respectively.

With continued reference to FIG. 20, dynamic tuning of load coupling is advantageous because the central controller can monitor the performance of the pad printing machine using actual and estimated move-times. Upon detection of a substantial degradation in operating speed due, for example, to a user speed change or a large load, the central controller can perform load matching by picking a different tuning set, that is, by using a new set of motion parameters. Further, by creating and storing several tuning sets, the pad printing machine of the present invention can undergo more gradual degradations in speed which are less noticeable by users. For example, tuning sets can be stored for use in ranges (i.e., slow, moderate, and fast) and two transitional ranges between the slow to moderate and moderate to fast speed ranges.

After dynamic tuning of cycle timing and load coupling is complete, the central controller determines from the plate extension register timer whether the plate extension dwell time specified by the user has expired, as shown in block 436 of FIG. 19. The central controller subsequently sends a pad-to-plate extension move command to the motor controller once the plate extension dwell time is complete, as shown by the affirmative branch of decision block 436 and block 438. The pad-to-plate extension move command comprises bytes indicating the designated speed and point along the pad axis for extending the pad toward the plate. As indicated by the affirmative branch of block 440 and block 442, the central controller starts a timer register to determine the actual pad-to-plate extension move-time after the motor controller returns an acknowledgment signal. The motor controller subsequently executes the move command and sends a move complete status signal to the central controller, as indicated by the affirmative branch of the decision block 444. The central controller begins a timer, as shown in block 446, to measure pad-to-plate dwell time. After the central controller receives the status signal, the central controller stops the timer register for pad-to-plate extension move time and obtains from its contents the actual pad-to-plate extension move time, as shown in block 448.

As stated previously, if the actual move-time is significantly different from the estimated move-time, the motor will most likely stall. As shown in decision blocks 450 and 452 and block 454, a mechanical problem with a motor or handler or other part of the pad printing machine will result in an error signal being generated by the central controller and sent to the user interface. The central controller subsequently returns the pad and plate to their home positions (block 368). If the error is not due to a mechanical problem, the user is notified via an error or message on the user interface display that another type of error has occurred, as shown in block 456. Accordingly, the central controller returns to a ready state (State 4 of FIG. 18) and waits for a TRIGGER or START/CYCLE signal.

As shown in block 458 of FIG. 19, the central controller compares the estimated and measured move-times for the pad-to-plate stroke length to determine their difference in value. With reference to block 460, the central controller uses the result obtained in block 458 to perform dynamic tuning to compensate for excessive load coupling and undesirable variances in cycle timing, as explained above in connection with block 406 of FIG. 19 and the flow chart depicted in FIG. 20.

As shown in decision block 462, the central controller determines from the pad-to-plate extension timer register whether the pad-to-plate dwell time has expired. After the pad-to-plate dwell time is complete, the central controller transmits a move command to the motor controller to move the pad from the plate, as shown in block 464. As shown in decision block 466 and block 468, the central controller starts a timer register to determine the actual pad-from-plate return move-time after the motor controller returns an acknowledgement signal. Once the motor controller executes the move command and sends a "move complete" status signal to the central controller, the central controller begins a timer to measure the pad-at-rest dwell time, as shown in decision block 470 and block 472. The central controller also stops the timer register for the pad-from-plate return move-time and obtains from its contents the actual move time, as shown in block 474. If the actual move-time is significantly different from the estimated move-time, the central controller will provide the user via the user interface with error signals, as shown in blocks 476, 478, 480 and 482, in a similar manner as described in blocks 450, 452, 454 and 456, respectively.

As shown in block 484 of FIG. 19, the central controller compares the estimated and measured move times to determine their difference in value. With reference to block 486, the central controller uses the result obtained in block 484 to perform dynamic tuning to compensate for excessive load coupling and their undesirable variances in cycle timing as described above in connection with block 406 of FIG. 19 and the flow chart depicted in FIG. 20.

As shown in block 488, the central controller transmits a move command to the motor controller to return the plate to its rest position at a designated speed along the plate axis. As indicated by the affirmative branch of block 490 and in block 492, the central controller starts a timer register to determine the actual plate-return move-time after the motor controller returns an acknowledgement signal. Once the motor controller executes the move command and sends "move complete" status signal to the central controller, the central controller begins a timer to measure the plate-return dwell time, as shown in block 496. The central controller also stops the timer register for measuring the plate return move-time and obtains therefrom the actual move-time, as indicated in block 498. With reference to blocks 500, 502, 504 and 506, if the actual move-time is significantly different from the estimated move-time, the central controller indicates via error messages transmitted to the user interface error conditions as were described in connection with blocks 450, 454, 452, and 456, respectively.

As indicated in block 508, the central controller compares the estimated measured move time to determine their difference in value. The central controller uses the result obtained in block 508 to perform dynamic tuning to compensate for variances in cycle timing and excessive load coupling as described in connection with block 406 of FIG. 19 and the flow chart depicted in FIG. 20.

As shown by the affirmative branch of decision block 512 and in block 514, the central controller determines from the pad-at-rest timer register whether the pad-at-rest dwell time has expired before transmitting a move command to the motor controller in order to move the pad to the product. The central controller starts a timer register to determine the actual pad-to-product extension move-time after the motor controller returns an acknowledgement signal, as indicated in decision block 516 and block 518. Once the motor controller has executed the move command and sends a "move complete" status signal to the central controller, the central controller begins a timer, as shown in block 522, to measure the pad-to-product dwell time. The central controller subsequently stops the timer register from measuring the pad-to-product extension move-time and obtains from its contents the actual move time, as shown in block 524. If the actual and estimated move times are significantly different, the central controller will provide the user with error messages via the user interface, as shown in blocks 526, 528, 530 and 532, in a manner similar to that described in connection with blocks 450, 454, 452 and 456, respectively.

The central controller subsequently compares the estimated and measured move times for pad-to-product stroke length to determine their difference in value, as shown in block 534. The central controller uses the result obtained in block 534 to perform the load coupling and cycle timing dynamic tuning discussed above in connection with block 406 of FIG. 19 and the flow chart depicted in FIG. 20.

In decision block 538 and in block 540, the central controller determines from the timer register assigned to measure pad-to-product dwell time whether the pad-to-product dwell time has expired before writing a move command to the motor controller in order to move the pad from the product to its rest position. As indicated in decision block 542 and block 544, the central controller begins a timer to measure the pad-from-plate move-time after receiving an acknowledgement signal from the motor controller indicating that the pad-from-product move command has been received by the motor controller. As shown in decision block 546 and in block 548, the central controller begins a post-cycle delay timer using a timer register after it has received a status signal from the motor controller indicating that the move command has been executed. The central controller subsequently stops the pad-from-product return timer (block 544) to obtain from its contents the actual pad-from-product move-time (block 550). If the actual pad-from-product move-time is significantly different from the estimated move-time determined above in connection with block 382, the central controller will provide the user with error messages via the user interface, as shown in blocks 552, 554, 556 and 558, in a manner similar to that described above in connection with blocks 450, 452, 454 and 456, respectively.

The central controller compares the estimated and measured move times for the pad-from-product stroke length to determine their difference in value, as shown in block 560. The central controller uses the result obtained in block 560 to perform dynamic tuning to compensate for undesirable variances in cycle timing or for excessive load coupling as described above in block 406 and in connection with the flow chart depicted in FIG. 20.

With reference to decision block 564, the central controller determines from the timer registers created to measure the plate return dwell time and post cycle delay times whether these times have expired before beginning another print cycle. As shown in decision block 566, the central controller waits to receive a TRIGGER or START CYCLE signal before beginning another print cycle. The pad printing machine is otherwise idled.

Although the present invention has been described with reference to preferred embodiments, the invention is not limited to details thereof. Various substitutions and modifications will occur to those of ordinary skill in the art, and all such substitutions and modifications are intended to fall within the scope of the invention as defined in the appended claims.

What is claimed is:

1. A method of pad transfer printing, comprising the following steps:

inputting process parameters regarding a desired print cycle to a controller, said process parameters including plate movement parameters and pad movement parameters, said plate movement parameters including independently selected plate extension and retraction velocities;

extending and retracting a gravure printing plate in accordance with said plate movement parameters between an inking position at which ink is applied to said plate and an ink transfer position at which an ink image is transferred from said plate to an ink transfer pad, said extension and retraction of said plate occurring at said independently selected plate extension and retraction velocities, respectively; and independently driving said ink transfer pad in accordance with said pad movement parameters between an ink receiving position at which said ink image is received from said plate and an ink transfer position at which said ink image is transferred to a surface to be printed.

2. The method of claim 1, wherein said plate movement parameters include a stroke length of the gravure printing plate and said pad movement parameters include a stroke length of the ink transfer pad, and wherein the steps of extending and retracting said plate and independently driving said pad comprise the steps of moving said plate and said pad in accordance with said stroke lengths.

3. The method of claim 1, wherein said pad movement parameters include a velocity of the ink transfer pad, and wherein the step of independently driving said pad comprises the step of moving said pad in accordance with said velocity.

4. The method of claim 1, wherein said process parameters include dwell periods between movements of the gravure printing plate and the ink transfer pad, and wherein the steps of extending and retracting said plate and independently driving said pad comprise the steps of moving said plate and said pad in accordance with said dwell periods.

5. The method of claim 1, wherein said process parameters include a delay period between successive print cycles.

6. The method of claim 1, wherein said process parameters include rest positions of said gravure printing plate and said ink transfer pad.

7. The method of claim 1, wherein said process parameters include a desired printing cycle time, and further comprising the steps of:

computing an estimated printing cycle time based on input process parameters other than said desired printing cycle time; and generating an error message if said estimated printing cycle time differs from said desired printing cycle time.

8. The method of claim 1, further comprising the steps of:

computing estimated move times for said gravure printing plate and said ink transfer pad based on said input process parameters, measuring actual move times for said gravure printing plate and said ink transfer pad; and modifying at least one of said process parameters if said actual move times differ from said estimated move times.

9. The method of claim 8, wherein individual ones of said process parameters are designated as either critical or noncritical, and wherein the step of modifying at least one of said process parameters comprises the step of modifying at least one non-critical process parameter without modifying critical process parameters.

10. The method of claim 9, wherein at least one said critical process parameters is selected from the group consisting of velocities and stroke lengths of said gravure printing plate and said ink transfer pad.

11. The method of claim 9, wherein at least one of said non-critical process parameters is selected from the group consisting of a delay period between successive print cycles and dwell periods between movements of said gravure printing plate and said ink transfer pad.

12. The method of claim 9, wherein the designation of said process parameters as either critical or non-critical is carried out during the step of inputting said process parameters to said controller.

13. The method of claim 1, further comprising the steps of:

computing estimated move times for said gravure printing plate and said ink transfer pad based on said input process parameters, measuring actual move times for said gravure printing plate and said ink transfer pad; and generating an error message if said actual move times differ from said estimated move times by more than a predetermined amount.

14. The method of claim 1, further comprising the steps of:

computing estimated move times for said gravure printing plate and said ink transfer pad based on said input process parameters, measuring actual move times for said gravure printing plate and said ink transfer pad; and modifying a load coupling to said gravure printing plate and to said ink transfer pad if said actual move times differ from said estimated move times by more than a predetermined amount.

15. A method of controlling a pad transfer printing cycle that includes at least one step of moving a gravure printing plate and at least one step of moving an ink transfer pad, comprising the following steps:

inputting process parameters to a controller regarding a desired printing cycle;

calculating the estimated time required to move each of the gravure printing plate and the ink transfer pad based on the process parameters;

moving the gravure printing plate in accordance with the process parameters and measuring the actual time of the movement;

comparing the estimated time required to move the gravure printing plate with the actual time of the movement and adjusting selected process parameters if the difference is outside a predetermined range;

moving the ink transfer pad in accordance with the process parameters and measuring the actual time of the movement; and comparing the estimated time required to move the ink transfer pad with the actual time of the movement and adjusting selected process parameters if the difference is outside a predetermined range.

16. The method of claim 15, further comprising the steps of:

storing several tuning sets of motion parameters related to the operation of motors that are used to move the gravure printing plate and the ink transfer pad; and retrieving a selected tuning set if the difference between estimated and actual move times of either the gravure printing plate or the ink transfer pad is outside a predetermined range.

17. The method of claim 16, wherein said motors comprise stepping motors, and wherein at least one of said motion parameters in each of said tuning sets is selected from the group consisting of holding-current duty cycle, jog-hold duty cycle, hold time, jog-hold time, and holding frequency.

18. The method of claim 15, wherein said input process parameters include critical and non-critical process parameters, and wherein the steps of adjusting selected process parameters comprises modifying non-critical process parameters without modifying critical process parameters.

19. The method of claim 18, wherein at least one of said critical process parameters is selected from the group consisting of velocities and stroke lengths for said gravure printing plate and said ink transfer pad.

20. The method of claim 18, wherein at least one of said non-critical process parameters is selected from the group consisting of a delay period between successive print cycles and dwell periods between movements of said gravure printing plate and said ink transfer pad.

* * * * *